US011384568B2

(12) United States Patent
Lee

(10) Patent No.: US 11,384,568 B2
(45) Date of Patent: Jul. 12, 2022

(54) LOCKING DEVICE FOR HINGED DOOR

(71) Applicant: FILOBE CO., LTD., Daegu (KR)

(72) Inventor: Kwang-Seog Lee, Daegu (KR)

(73) Assignee: FILOBE CO., LTD., Daegu (KR)

( * ) Notice: Subject to any disclaimer, the term of this patent is extended or adjusted under 35 U.S.C. 154(b) by 385 days.

(21) Appl. No.: 16/324,565

(22) PCT Filed: Aug. 14, 2017

(86) PCT No.: PCT/KR2017/008838
§ 371 (c)(1),
(2) Date: Feb. 10, 2019

(87) PCT Pub. No.: WO2018/030876
PCT Pub. Date: Feb. 15, 2018

(65) Prior Publication Data

US 2020/0040610 A1 Feb. 6, 2020

(30) Foreign Application Priority Data

Aug. 12, 2016 (KR) ..... 10-2016-0102999

(51) Int. Cl.

| | |
|---|---|
| ***E05B 63/00*** | (2006.01) |
| ***E05B 17/00*** | (2006.01) |
| ***E05B 17/08*** | (2006.01) |
| ***E05B 63/24*** | (2006.01) |

(52) U.S. Cl.
CPC ..... *E05B 63/0052* (2013.01); *E05B 17/0025* (2013.01); *E05B 17/08* (2013.01); *E05B 63/0008* (2013.01); *E05B 63/24* (2013.01); *E05Y 2900/132* (2013.01)

(58) Field of Classification Search
CPC .. E05B 63/0052; E05B 17/0025; E05B 17/08; E05B 63/0008; E05B 63/24; E05Y 2900/132
USPC ..... 292/9, 15, 23, 193, 32, 33, DIG. 46, 292/DIG. 68; 49/276, 277, 278
See application file for complete search history.

(56) References Cited

U.S. PATENT DOCUMENTS

2017/0122014 A1* 5/2017 Andrasfi ..... E05C 9/021

FOREIGN PATENT DOCUMENTS

| | | | | |
|---|---|---|---|---|
| EP | 1788171 | A1 * | 5/2007 | ..... B63B 19/00 |
| JP | 2010-101086 | A | 6/2010 | |
| KR | 10-2003-0049417 | | 6/2003 | |
| KR | 20-0450340 | Y | 9/2010 | |
| KR | 10-2011-0026356 | A | 3/2011 | |
| KR | 10-2013-0104344 | A | 9/2013 | |

* cited by examiner

*Primary Examiner* — Christine M Mills
*Assistant Examiner* — Yahya Sidky
(74) *Attorney, Agent, or Firm* — Neifeld IP Law PLLC

(57) ABSTRACT

The present invention relates to a hinged door locking device and, more particularly, to a hinged door locking device comprising a rotatable lever installed on a door frame separately from a main locking device generally used for security, wherein a side to be opened by rotation in the hinged door is brought into tight contact with the door frame at multiple points in the longitudinal direction by operating the lever. Thus, the hinged door locking device is configured to readily maintain the tight contact and has high usability as an auxiliary locking device.

13 Claims, 32 Drawing Sheets

[a-a' section : locked state]

[a-a' section : unlocked state]

[a-a' section : locked state]

[b-b' section: uncompressed/lcoked state]

[b-b' section : compressed/lcoked state]

LOCKING DEVICE FOR HINGED DOOR

CROSS REFERENCE TO RELATED APPLICATIONS

This application is a 371 National Stage Entry of PCT/KR2017/008838 filed Aug. 14, 2017, and PCT/KR2017/008838 claims priority to Korean Application 10-2016-0102999, filed Aug. 12, 2016. The contents of Korean Application 10-2016-0102999, filed Aug. 12, 2016, is incorporated by reference in its entirety.

TECHNICAL FIELD

The present invention relates to a locking device of a hinged door, and more specifically, to a locking device of a hinged door which allows a rotation-opening side of the hinged door to be pressed against a door frame at a plurality of points in a longitudinal direction by operating a rotatable lever installed on a door frame separately from a generally used main locking device for security, and more easily maintains a fixed state in a compressed-contact state, and is used as an auxiliary locking device of the hinged door.

BACKGROUND ART

Doors for a building entrance with a hinged door structure and various hinged doors installed indoor (referred to as the hinged door in the specification, including a hinged door for entrance and a hinged window) use various locking devices. As a general prior art of the locking device of a hinged door and a hinged window, locking devices with various structures, such as "Locking Device of Hinged Door" in Korean Registration Patent (B1) No. 10-1237681 (Feb. 26, 2013), "Locking Device of Hinged Door" in Korean Utility Model Registration (Y1) No. 20-0271060 (Apr. 9, 2002), and "Locking Device of Hook Direction Changing Type-Hinged Door" in Korean Utility Model Registration (Y1) No. 20-0476646 (Mar. 18, 2015), and the like, are disclosed. As shown in FIGS. 1A to 1C, the locking devices in the prior art are in a locked state when a locking cylinder 1*s* installed on a rotation-opening side of the hinged door 1 installed on a door frame using a door hinge 1*b* installed on one side of a door frame 1*a* moves forward and is inserted into a cylinder pocket 1*sa* installed to face the door frame 1*a* (see FIGS. 1B and 2Bb) or are in a unlocked state when the locking cylinder 1*s* comes out of the cylinder pocket 1*sa* and moves backward toward the hinged door 1 (see FIG. 1C). An operation in which the locking cylinder 1*s* moves forward or backward from the cylinder pocket 1*sa* of the locking cylinder 1*s* may be performed by a manual rotation operation of a door handle 1*h* mounted on the hinged door 1 or other various electronic opening and closing devices.

However, since the conventional locking devices are used for security, the locking device only has a structure of maintaining a locked state in which a hinged door is locked on a door frame and performs a locking function at one point of the hinged door in a longitudinal direction of the hinged door as shown in FIG. 1A. As shown in FIG. 2B which is an enlarged transverse sectional view illustrating the locked state in which the hinged door is closed, an operation gap Δg is necessary between the locking cylinder 1*s* and the cylinder pocket 1*sa* for smooth operation, and the hinged door is separated from the door frame by a gap when strong wind blows, and thus it is difficult to maintain a good airtight state, and further, it causes rattling and noise.

Further, use of various electronic opening and closing devices as the locking device of a hinged door has been increasing recently. In the case of the electronic opening and closing device (an electronic door lock), when the locked state is released due to external strong electric shock or password exposure, an intrusion path to go inside may be provided, and thus a separate locking device is further required.

Technical Problem

The present invention is directed to providing a locking device of a hinged door capable of being used as an auxiliary locking device that allows a gap between the hinged door and a door frame to be controlled in order to provide a better airtight condition after the hinged door is closed and locked by a general locking device.

The present invention is directed to providing a locking device of a hinged door capable of being locked or opened by rotating a lever only from an indoor space divided by a hinged door in order to solve a security problem of a locking device generally used for a hinged door.

Technical Solution

One aspect of the present invention provides a locking device of a hinged door installed between a rotation opening side of the hinged door, which is installed in a door frame using a door hinge installed on one side of the door frame, and a door frame, the locking device including a plurality of close contact guide plates installed on the rotation opening side of the hinged door to be separated from each other in a longitudinal direction; a plurality of pressure rolls configured to achieve a compressed locked state by pulling the rotation opening side of the hinged door toward the door frame while in contact with the close contact guide plates in a state in which the rotation opening side of the hinged door is closed on the door frame, and installed on the door frame to be separated from each other in the longitudinal direction to achieve the uncompressed locked state between the rotation opening side of the hinged door and the door frame in a noncontact state with the close contact guide plates; a driving plate installed in the sliding pocket, provided in the door frame in the longitudinal direction so that the pressure rolls 120 are slidably installed on the door frame in the longitudinal direction, and having the plurality of pressure rolls provided in the longitudinal direction; and a switching device configured to induce a longitudinal movement displacement corresponding to that of the driving plate by being engaged with at least one first pressure roll of the pressure rolls installed on the driving plate to provide the longitudinal movement displacement, configured to generate a longitudinal movement displacement of the second pressure roll induced by the longitudinal movement displacement of the driving plate, and installed on the door frame to allow the second pressure roll to be switched between a contact compressed state position with the close contact guide plates and the contact compressed state position by the longitudinal movement displacement, wherein the switching device includes a housing fixedly installed on the door frame, a rotatable lever installed in the housing by a first hinge pin to rotate on a front surface of the housing in the longitudinal direction, a conversion link bar having one end portion connected at a predetermined position between the first hinge pin of the rotatable lever and a rotation end portion, a sliding block connected to the other end portion of the conversion link bar by a third hinge pin to slide linearly in the housing in the longitudinal direction according to a longitudinal rotation operation of the rotatable lever, a cover plate configured to cover a rear surface of the housing to limit a displacement of the sliding block by a longitudinal rotation operation of the rotatable lever to a longitudinal linear sliding displacement in the housing and having a hole formed in the longitudinal direction to guide the longitudinal linear sliding displacement and having a size such as to limit the height of the longitudinal linear sliding displacement, and a slider fork integrated with the sliding block, provided to protrude to an outside of a sliding guide groove formed in the cover plate, and sliding along the sliding guide groove in the longitudinal direction while being engaged with the first pressure roll.

The switching device further includes a rotatable lever releasing blocking unit for blocking release of the rotatable lever before external force greater than a predetermined strength is applied to the rotatable lever to rotate the rotatable lever so as to maintain the second pressure roll to be fixed at a contact compressed state position with the close contact guide plates or a noncontact and uncompressed state position.

To provide a first rotatable lever releasing blocking unit which is one of the rotatable lever releasing blocking units, a neutral state in which the third hinge pin, the first hinge pin, and a second hinge pin are sequentially disposed on an upward inclined straight line is made while the rotatable lever composing the switching device rotates upward about the first hinge pin so that the second hinge pin is positioned above the first hinge pin, a sliding guide groove upper limit line U.L. is set at a position limiting a free further upward movement of the sliding block and the slider fork before the neutral state, additional upward movements of the sliding block and the slider fork are elastically received by elastic compression deformation of an upper region of the cover plate induced by an upward displacement exceeding the sliding guide groove upper limit line U.L. while the rotatable lever rotates upward to reach the neutral state, and the sliding block connected to the link bar and the slider fork are moved slightly downward by elastically pressed elastic recovery deformation of the upper region of the cover plate in a section in which the rotatable lever additionally rotates upward to reach the vertically upright state beyond the neutral state, and thus a position of a sliding guide groove upper limit line U.L. of the sliding guide groove is set to limit a reverse direction operation of the rotatable lever, the sliding block, and the slider fork integrated with the sliding block until external force strong enough to re-perform elastic compression deformation of the upper region of the cover plate is applied to the rotatable lever according to slight upward movements of the sliding block and the slider fork for recovering the slight downward movement.

To provide a second rotatable lever releasing blocking unit, which is another one of the rotatable lever releasing blocking units, the rotatable lever composing the switching device rotates downward about the first hinge pin to reach a vertically downward state so that the second hinge pin is positioned below the first hinge pin and a state in which the first hinge pin, the second hinge pin, and the third hinge pin are disposed downward sequentially in a triangular structure is made, a sliding guide groove lower limit line L.L. is set at a position limiting additional free downward movements of the sliding block and the slider fork before the vertically downward state, additional downward movements of the sliding block and the slider fork are elastically received through elastic compression deformation induced by a downward displacement exceeding the sliding guide groove lower limit line L.L. while the rotatable lever moves downward to reach the vertically downward state, a lever downward moving unit and a lever recovery unit are provided between the housing and the rotatable lever to induce a further slight downward movement and recovery of the rotatable lever while the rotatable lever rotates downward to reach the vertically downward state beyond the sliding guide groove lower limit line L.L. which limits free downward movements of the sliding block and the slider fork, and therefore reverse operations of the rotatable lever, the sliding block, and the slider fork integrated with the sliding block are limited until elastic compression deformation of the cover plate-lower region by forcible further slight downward movement of the rotatable lever is re-performed by the rotatable lever rotated from the lever recovery unit through the lever downward moving unit in a reverse direction.

The lever downward moving unit includes a catching protrusion protruding from a side wall of the housing, a catching projection provided in an entrance portion of the catching groove formed in a side surface of the rotatable lever to be concave to correspond to the catching protrusion, and a long hole portion, which is a hinge hole of the rotatable lever to which the first hinge pin is fastened to receive downward movement of the rotatable lever performed when the catching projection comes out of a lower end portion of the catching protrusion, includes a vertical hole for the first hinge, wherein the lever recovery unit includes a catching protrusion expanded mounting portion in the catching groove provided to receive elastic recovery deformation of the cover plate-lower region.

Advantageous Effects

According to the present invention, the locking device can provide a better airtight condition and does not cause noise due to rattling of a hinged door even in strong winds by providing an auxiliary locking device for controlling a gap between a hinged door and a door frame so that the hinged door is closely pressed against the door frame at a plurality of points in a longitudinal direction after the hinged door is closed and locked by a general locking device.

Particularly, a rotatable lever releasing blocking unit for blocking release of the rotatable lever before external force greater than a predetermined strength is applied to the rotatable lever to rotate the rotatable lever is additionally provided, and thus an effect of maintaining a second pressure roll of a switching device to be fixed at a contact compressed state position with the close contact guide plates or a noncontact and uncompressed state position can be provided.

Further, according to the present invention, a security problem of an electronic locking device generally used for a hinged door can be solved by an auxiliary locking device that allows locking or opening only by rotating a lever from an indoor space divided by a hinged door.

MODES OF THE INVENTION

Hereinafter, embodiments that are easily performed by those skilled in the art will be described in detail with reference to the accompanying drawings. However, the embodiments of the present invention may be achieved in several different forms and are not limited to the embodiments described herein.

Figure 1A:
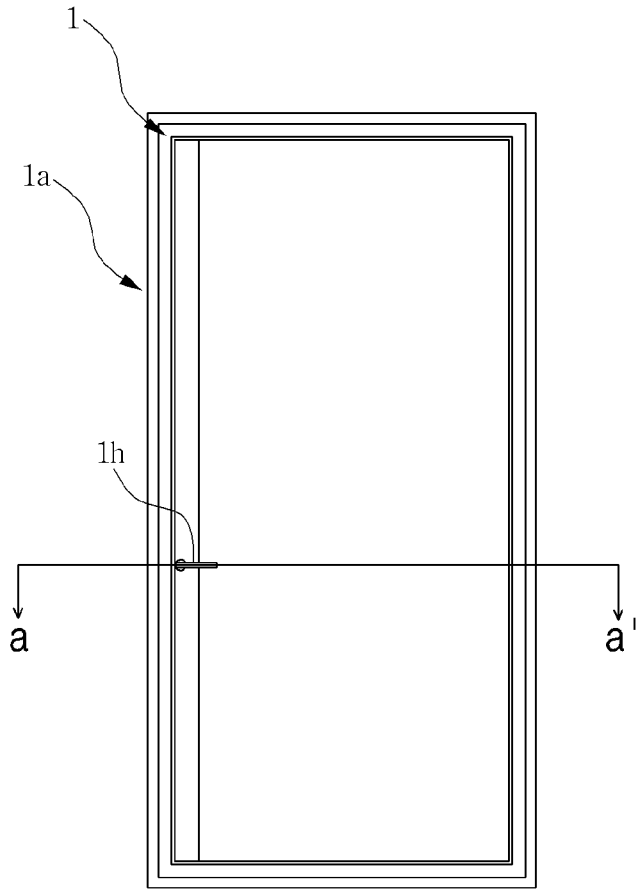
FIG. 1A is a front view showing a hinged door installed in a door frame using a door hinge installed on one side of the door frame.
Figure 1B:
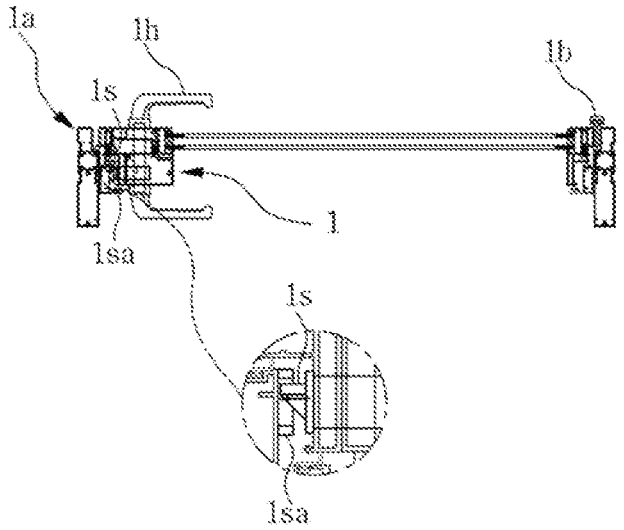
FIG. 1B is a cross-sectional view taken along line a-a' of FIG. 1A in a state of being locked by a general door handle.
Figure 1C:
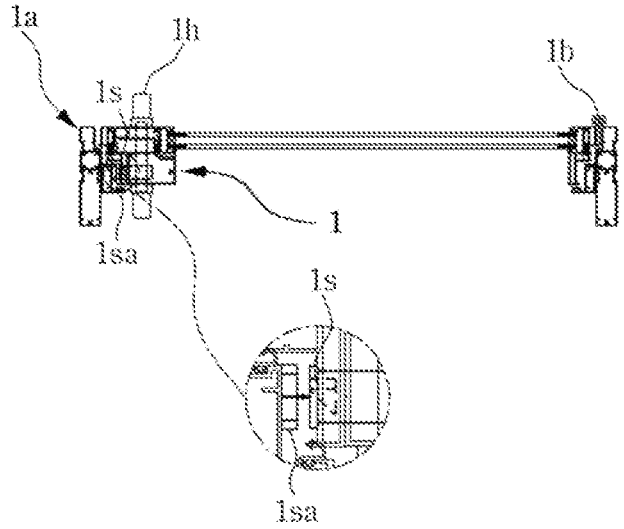
FIG. 1C is a cross-sectional view taken along line a-a' of FIG. 1A in a state of being unlocked by a door handle.
Figure 2A:
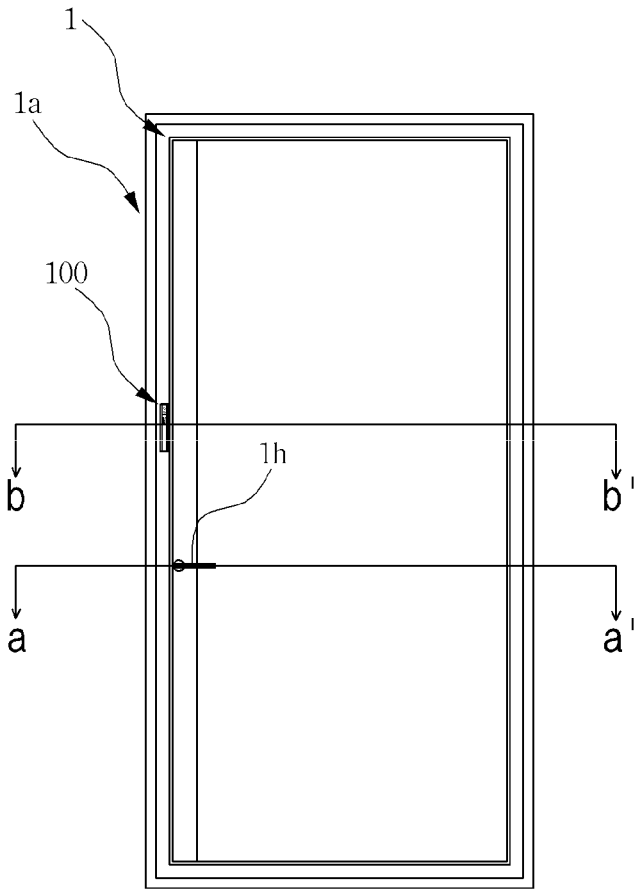
FIG. 2A is a front view showing a state in which a locking device of a hinged door according to the present invention is installed between a door frame and a rotation-opening side of the hinged door installed in the door frame using a door hinged installed on one side of the door frame.
Figure 2B:
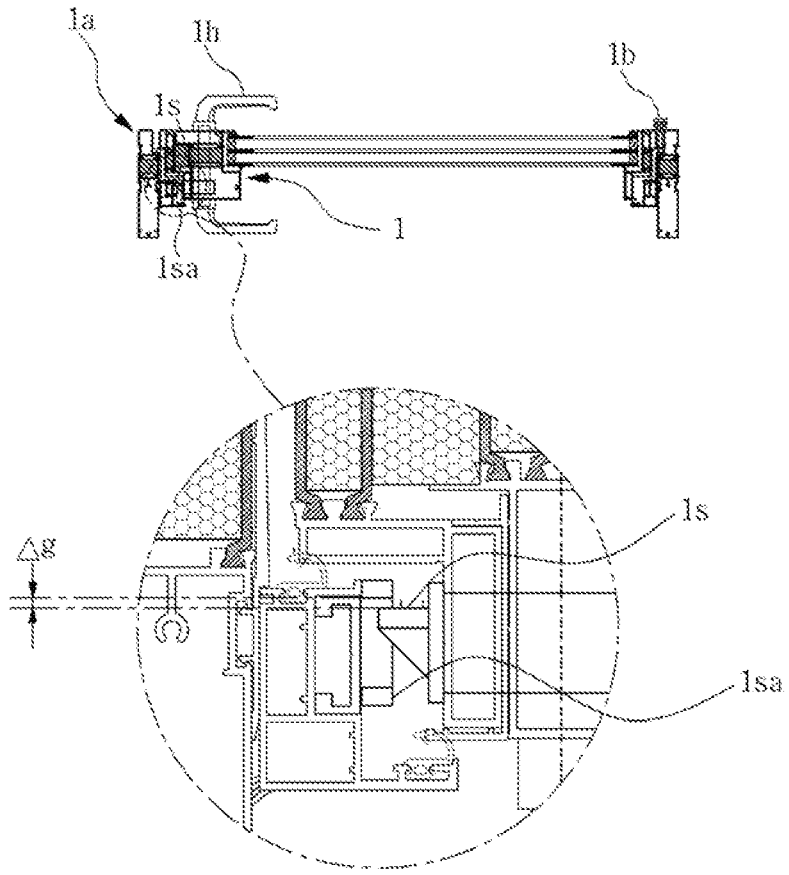
FIG. 2B is a cross-sectional view taken along line a-a' of FIG. 2A in a locked state.
Figure 2C:
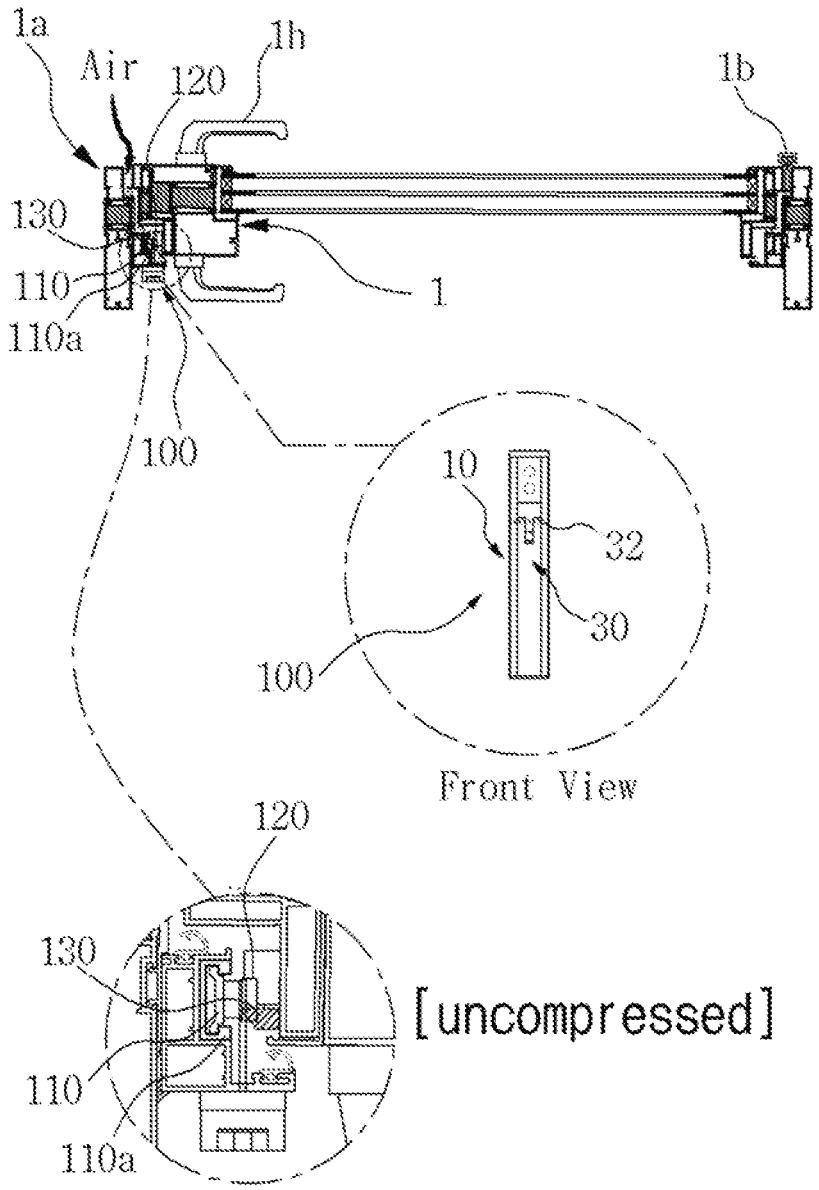
FIG. 2C is a cross-sectional view taken along line b-b' of FIG. 2A in a uncompressed/locked state.

According to the present invention, a locking device is, as shown in FIGS. 2A and 2C, as an auxiliary locking device of a hinged door 1 installed between a rotation opening side of the hinged door 1 installed in a door frame and a door frame 1*a* using a door hinge 1*b* installed on one side of the door frame and, as shown in FIGS. 2A to 7K, provided is an auxiliary locking device which includes a plurality of close contact guide plates 130 installed on a rotation opening side of the hinged door 1 to be separated from each other in a longitudinal direction, a plurality of pressure rolls 120 which achieve a compressed-locked state by pulling the rotation opening side of the hinged door 1 toward a door frame 1*a* when in contact with the close contact guide plate 130 in a state in which the rotation opening side of the hinged door 1 is closed to the door frame 1*a* and which are installed on the door frame 1*a* to be separated from each other in a longitudinal direction so that the rotation opening side of the hinged door 1 achieves a uncompressed-locked state on the door frame 1*a* in a noncontact state with the close contact guide plates 130, a driving plate 110 installed in a sliding pocket 110*a* provided in the door frame 1*a* in the longitudinal direction so that the pressure rolls 120 slidably move toward the door frame 1*a* in the longitudinal direction and provided with the pressure rolls 120 formed on the front surface thereof to be separated from each other in the longitudinal direction, and a switching device 100 which induces a longitudinal movement displacement H corresponding to that of the driving plate 110 by being engaged with a first pressure roll 120*a* of the pressure rolls 120 installed on the driving plate 110 to provide the longitudinal movement displacement H, generates a longitudinal movement displacement H of a second pressure roll 120*b* induced by the longitudinal movement displacement H of the driving plate 110, and is installed in the door frame 1*a* to allow the second pressure roll 120*b* to switch between a contact compressed state position with the close contact guide plates 130 and a noncontact-uncompressed state position through the longitudinal movement displacement H.

In this case, the switching device 100 includes a housing 10 fixedly installed on the door frame 1*a*, a rotatable lever 30 installed in the housing 10 by a first hinge pin 32 to be rotated on a front surface of the housing in the longitudinal direction, a conversion link bar 40 having one end portion connected at a predetermined position between a first hinge pin 32 of the rotatable lever 30 and a rotating end portion by a second hinge pin 40*a*, a sliding block 20 connected to the other end portion of the conversion link bar 40 by a third hinge pin 40*b* and sliding linearly in the housing 10 in the longitudinal direction according to a longitudinal rotation operation of the rotatable lever 30, a cover plate 50 for covering a rear surface of the housing 10 to limit a displacement of the sliding block 20 caused by the longitudinal rotation operation of the rotatable lever 30 to a longitudinal linear sliding displacement in the housing 10 and including a sliding guide groove 52 for guiding the longitudinal linear sliding displacement and having a hole formed in the longitudinal direction in a size limiting the height of the sliding displacement, and a slider fork 25 integrated with the sliding block 20, protruding to the outside of the sliding guide groove 52 formed in the cover plate 50, and sliding along the sliding guide groove 52 in the longitudinal direction while being engaged with the first pressure roll 120*a*.

In this case, unlike the second pressure roll 120*b*, the first pressure roll 120*a* is an element engaged with the slider fork 25, not an element which is in contact with the close contact guide plates 130, and thus the name of the element may vary, but functions of the first pressure roll 120*a* and the second pressure roll 120*b* of the plurality of pressure rolls 120 may be changed when an installation position of the switching device 100 installed in the door frame 1*a* is changed, and thus a unified name is used in the present specification, and the pressure rolls 120 may be a cylindrical roller having a touched outer circumferential surface freely rotating about a central portion so that excessive frictional force or frictional noise is not generated in a process of being engaged with the slider fork 25 or in a process of moving while in contact with the close contact guide plate 130.

Further, a rotatable lever releasing blocking unit for blocking a releasing operation of the rotatable lever 30 to rotate the rotatable lever 30 before external force greater than a predetermined strength is applied to the rotatable lever 30 may be additionally provided in the switching device 100 in order for the second pressure roll 120*b* to maintain a fixed state at a contact compressed state position with the close contact guide plate 130 or a noncontact-uncompressed state position.

In this case, to provide the rotatable lever releasing blocking unit, which is one of the rotatable lever releasing blocking unit, while the rotatable lever 30 composing the switching device 100 rotates upward about the first hinge pin 32 so that the second hinge pin 40*a* is positioned above the first hinge pin 32, the third hinge pin 40*b*, the first hinge pin 32, and the second hinge pin 40*a* are sequentially disposed in a neutral state N.A. to be disposed in a straight line inclined upward, and a sliding guide groove upper limit line U.L. is set at a position limiting the additional free upward movements of the sliding block 20 and the slider fork 25 before the neutral state N.A. A further upward movement of the sliding block and the slider fork are elastically received by elastic compression deformation of an upper region 50*b* of the cover plate 50 induced by an upward displacement exceeding an upper line of the sliding guide groove while the rotatable lever 30 rotates upward to reach the neutral state N.A., and the sliding block 20 and the slider fork 25 connected to the link bar 40 are moved slightly downward using the third hinge pin 40*b* by elastic recovery deformation of the upper region 50*b* of the elastically pressed cover plate 50 in a section in which the rotatable lever is additionally rotated upward to a vertically upright state beyond the neutral state. A sliding guide groove upper limit line U.L. position of the sliding guide groove 52 may be set to limit a reverse operation (downward rotation and downward movement) of the rotatable lever 30, the sliding block 20, and the slider fork 25 integrated with the sliding block 20 until external force strong enough for elastic compression deformation of the upper region 50*b* of the cover plate 50 to be re-performed according to slight upward movement of the sliding block and the slider fork for recovering slight downward movement is applied to the rotatable lever 30.

Further, to provide a second rotatable lever releasing blocking unit, which is another one of the rotatable lever releasing blocking units, while the rotatable lever 30 composing the switching device 100 rotates downward about the first hinge pin 32 to a vertically downward state so that the second hinge pin 40*a* is positioned below the first hinge pin 32, the first hinge pin 32, the second hinge pin 40*a*, and the third hinge pin 40*b* are disposed downward sequentially in a triangular structure, and a sliding guide groove lower limit line L.L. is set at a position limiting additional free upward moving of the sliding block 20 and the slider fork 25 before the vertically downward state. A further downward movement of the sliding block 20 and the slider fork 25 are elastically received by elastic compression deformation of the lower region 50*a* of the cover plate 50 induced by an upward displacement exceeding the sliding guide groove lower limit line L.L. while the rotatable lever 30 rotates downward to reach the vertically downward state, and a lever downward moving unit and a lever recovery unit may be provided between the housing and the rotatable lever to induce forcible further slight downward movement and recovery of the rotatable lever 30 in a downward rotation section until the rotatable lever 30 reaches the vertically downward state beyond the sliding guide groove lower limit line L.L. state in which free downward movement of the sliding block 20 and the slider fork 25 is limited, and therefore, a reverse operation (upwardly rotating and upwardly moving) of the rotatable lever 30, the sliding block 20, and the slider fork 25 integrated with the sliding block 20 is limited until elastic compression deformation of the cover plate-lower region 50*a* is re-performed by the forcible further slight downward movement of the rotatable lever 30 by the rotatable lever 30 rotated from the lever recovery unit through the lever downward moving unit in a reverse direction.

In this case, the lever downward moving unit includes a catching protrusion 10*s* protruding from a side wall of the housing 10, a catching projection 30*sa* formed on a side surface of the rotatable lever 30 to be concave to correspond to the catching protrusion 10*s*, and a long hole portion 30*e* which is a hinge hole of the rotatable lever 30 to which the first hinge pin 32 is fastened to allow the rotatable lever 30 to move downward when the catching projection 30*sa* comes out of a lower end portion of the catching protrusion 10*s* and includes a vertical gap for the first hinge pin 32, and the lever recovery unit includes a catching protrusion expanded mounting portion 30*se* formed in the catching groove 30*s* to receive elastic recovery deformation of the cover plate-lower region 50*a*.

Hereinafter, detailed configurations and operation processes of the embodiments of the present invention will be described in more detail with reference to the accompanying drawings.

Figure 2D:
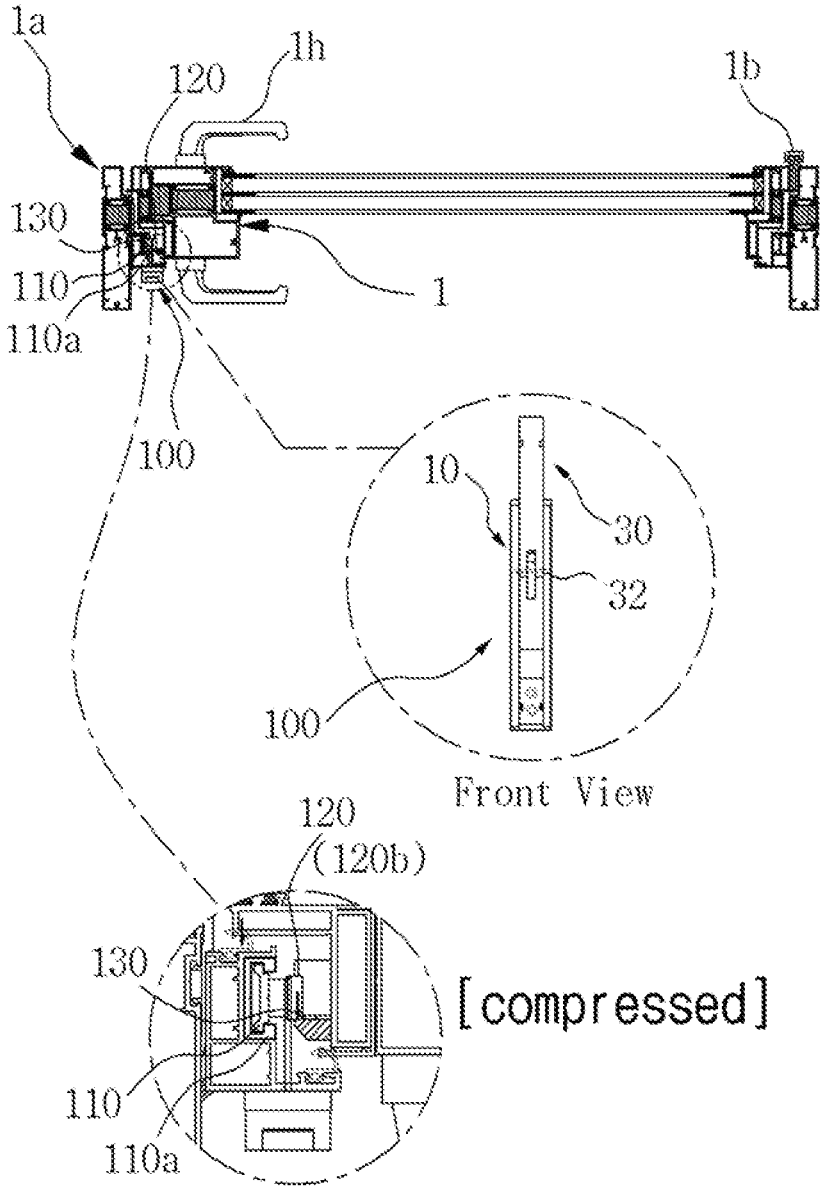
FIG. 2D is a cross-sectional view taken along line b-b' of FIG. 2A in a compressed/locked state.

As shown in FIG. 2A, the locking device of the hinged door according to the present invention is installed between a rotation opening side of the hinged door 1 and the door frame 1*a*, and as shown in FIG. 2B, which shows a cross-sectional view in a state of being locked by a door handle 1*h* in the front view of FIG. 2A as a cross-sectional view taken along line a-a', in the state of being locked by the door handle 1*h*, a predetermined size of an operation gap ($\Delta g$) is required between the locking cylinder 1*s* and the cylinder pocket 1*sa*, and thus a gap is formed between the rotation opening side of the hinged door 1 and the door frame 1*a*. FIGS. 2C and 2D are shown as drawings for showing an operation state by an auxiliary locking device according to the present invention in a transverse section taken along line b-b' in the front view of FIG. 2A. FIG. 2C is a cross-sectional view taken along line b-b' of FIG. 2A and shows a state of being uncompressed (by the auxiliary locking device according to the present invention) and locked (by the door handle), and FIG. 2D is a cross-sectional view taken along line b-b' of FIG. 2A and shows a cross-sectional state in a state of being pressed (by an upward rotating operation of the rotatable lever 30 of the switching device 100 composing the auxiliary locking device according to the present invention) and locked (by a door handle).

Figure 3A:
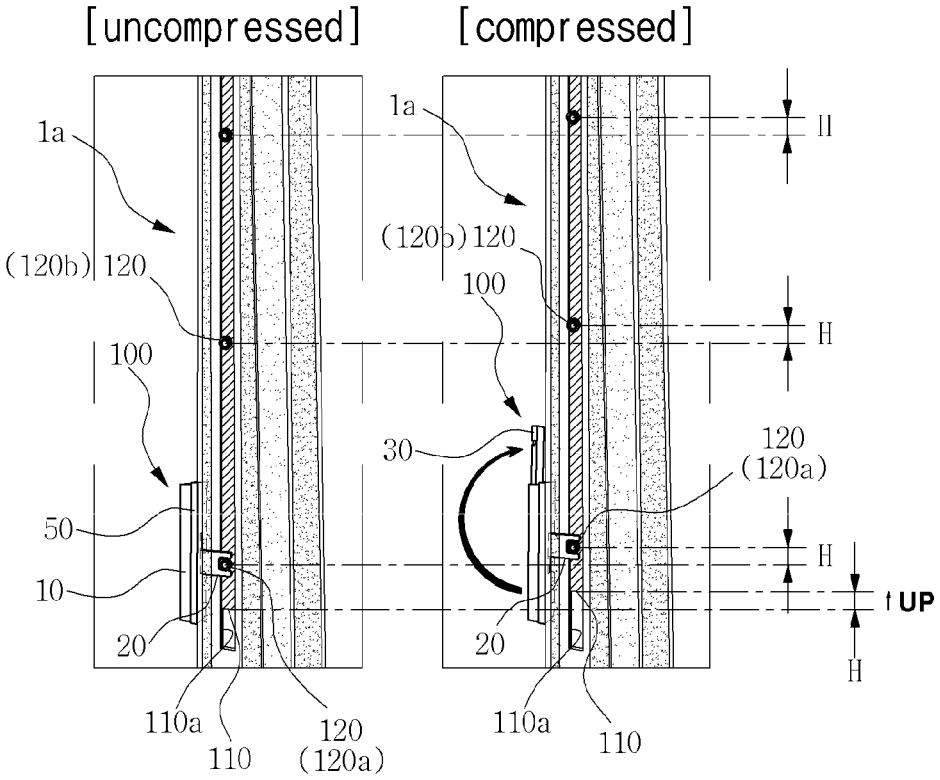
FIG. 3A is a view showing an operation state in which, when the locking device of a hinged door according to the present invention is installed on one side of the door frame, an operating plate with a pressing roll slides from a door frame side in a longitudinal direction by rotating a rotatable lever in a vertical direction so as to switch a uncompressed/locked state to a compressed/locked state.

As shown in a perspective view for the door frame of FIG. 3A, to achieve a conversion operation state shown in transverse sections of FIGS. 2C and 2D, the driving plate 110 in which the first pressure roll 120*a* is installed slides in the sliding pocket 110*a*, which is provided in the door frame 1*a* in the longitudinal direction, in the longitudinal direction by rotating the rotatable lever 30 upward in a state in which the locking device of the hinged door according to the present invention is installed on one side of the door frame to provide a longitudinal movement displacement H and to generate a longitudinal movement displacement H of the second pressure roll 120*b* induced by the longitudinal movement displacement H of the driving plate 110.

Figure 3B:
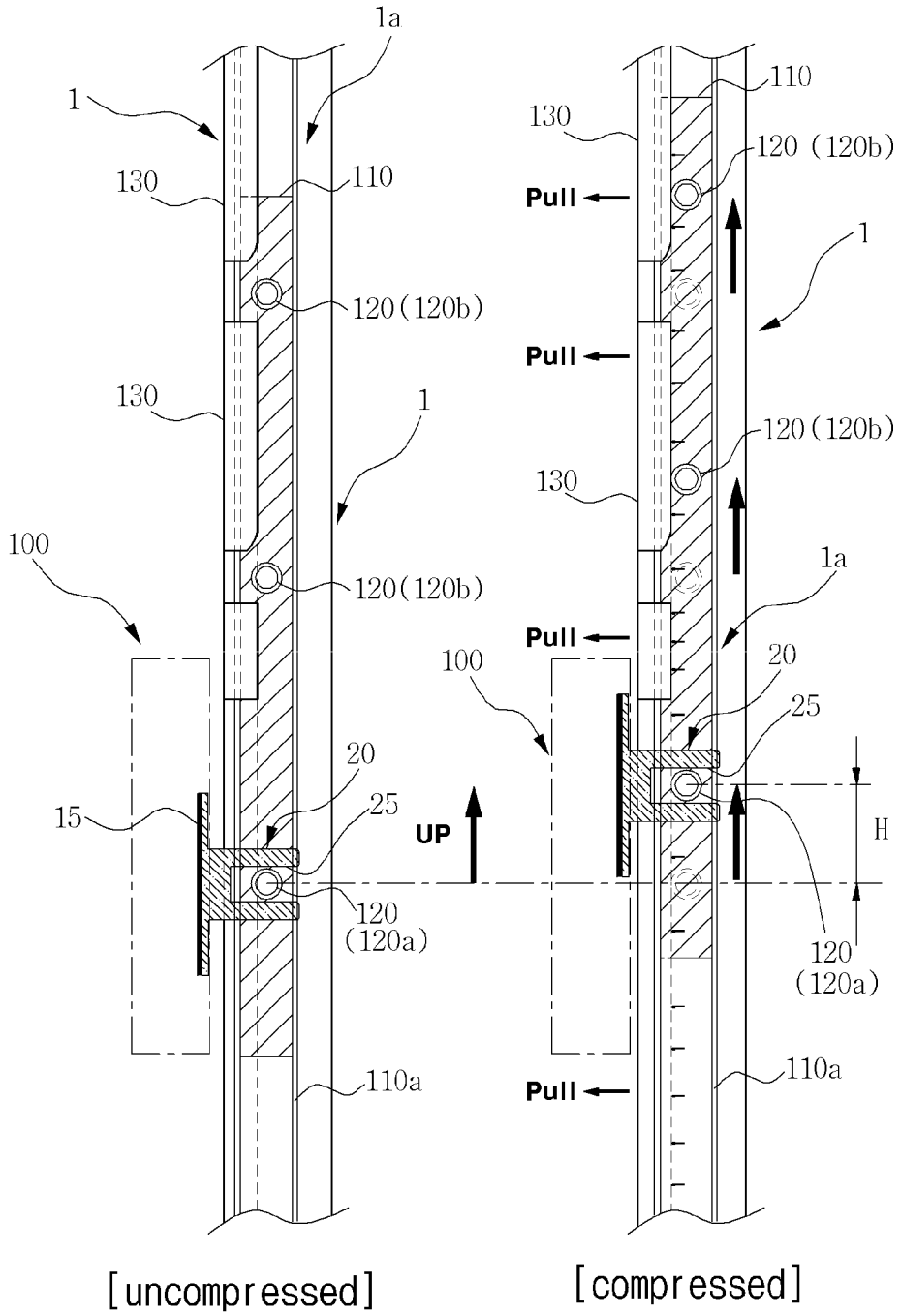
FIG. 3B is a view showing an operation state in which a plurality of close contact guide plates, which are installed on a rotation opening side of the hinged door to be separated from each other in the longitudinal direction, are pulled toward the door frame side when the operation plate with the pressing roll shown in FIG. 3A slides from the door frame side in the longitudinal direction so as to switch from the uncompressed/locked state to the compressed/locked state.

Therefore, as shown in FIG. 3B showing the plurality of close contact guide plates 130, which are installed on a rotation opening side of the hinged door 1 and the door frame 1*a* to be separated from each other in a longitudinal direction, in the longitudinal section, the plurality of close contact guide plates 130 provided on the rotation opening side of the hinged door 1 to be in contact with the second pressure roll 120*b* are pulled toward the door frame by the longitudinal movement displacement H of the second pressure roll 120*b* to switch from the noncontact-uncompressed state (a uncompressed/locked state) position to the contact compressed state (a compressed/locked state) position.

Hereinafter, in the switching device composing the locking device of the hinged door according to the embodiments of the present invention, an operation state of the switching device 100 for switching between the contact compressed state position with the close contact guide plates 130 and the noncontact uncompressed state position by the longitudinal movement displacement of the second pressure roll 120*b* will be described in more detail with reference to cross-sectional views of processes of the operation states shown in FIGS. 6A to 6E and the exploded perspective views of processes of the switching device 100 shown in FIGS. 4A to 4E.

Figure 4A:
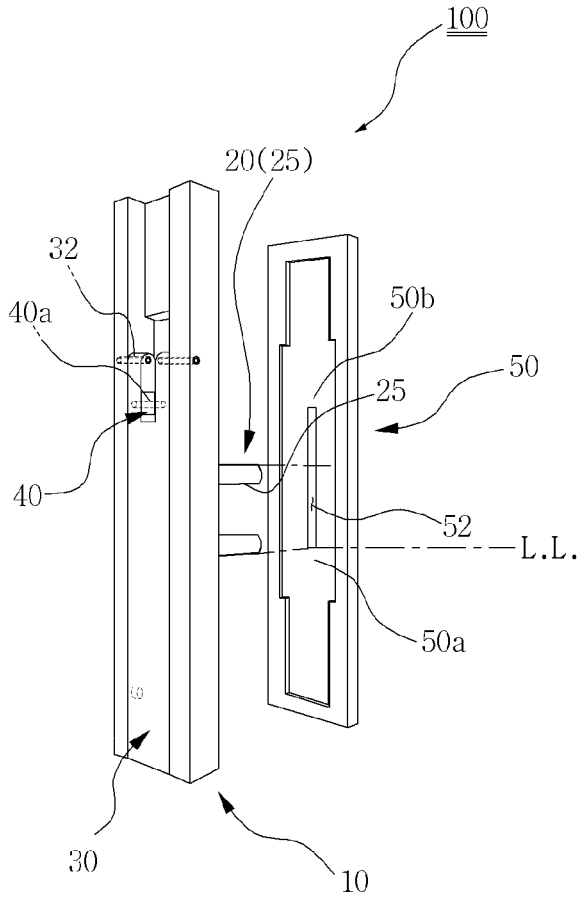
FIGS. 4A to 4E are exploded perspective views showing processes of an operation state of the switching device, which is a switching device composing the locking device of a hinged door according to the present invention, installed on the door frame to switch a pressure roll between a contact-compressed state position with the close contact guide plate and a noncontact-uncompressed state position through a longitudinal movement displacement.
Figure 6A:
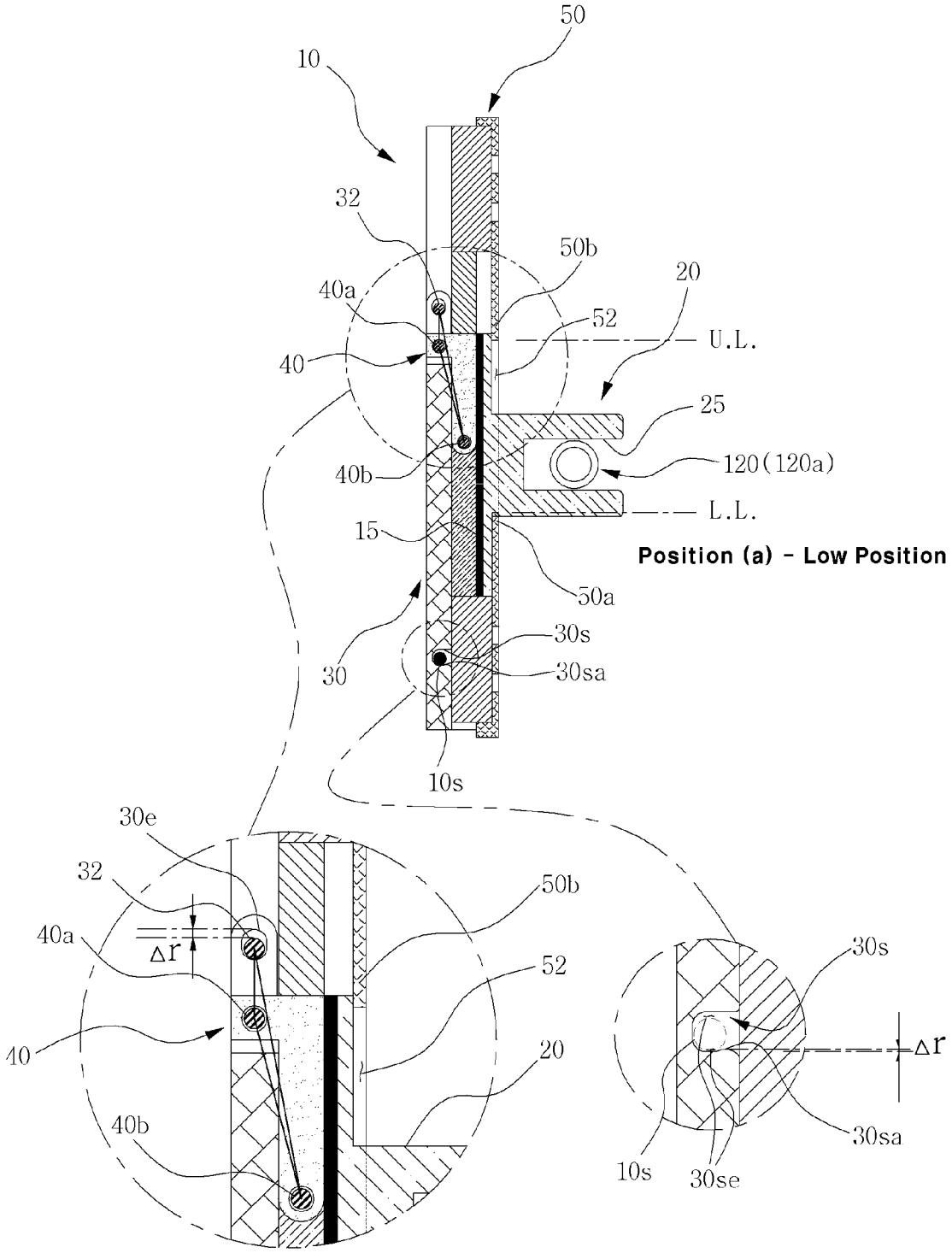
FIGS. 6A to 6E are cross-sectional views showing processes of an operation state in which a contact compressed state (a compressed/locked state) is performed by rotating the rotatable lever upward to move the sliding block and the slider fork upward while the locking device of a hinged door according to the present invention is installed on one side of the door frame.
Figure 6B:
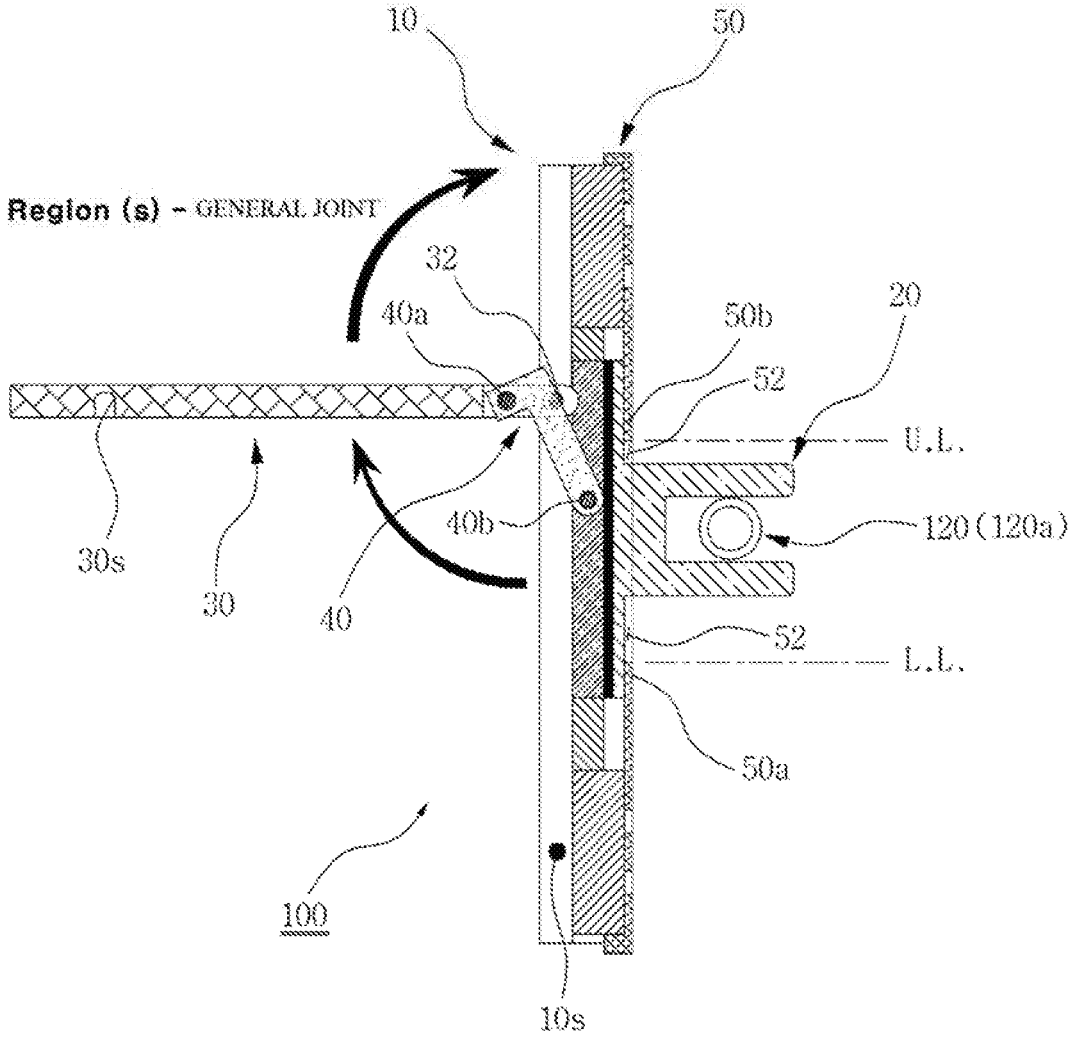
Figure 6C:
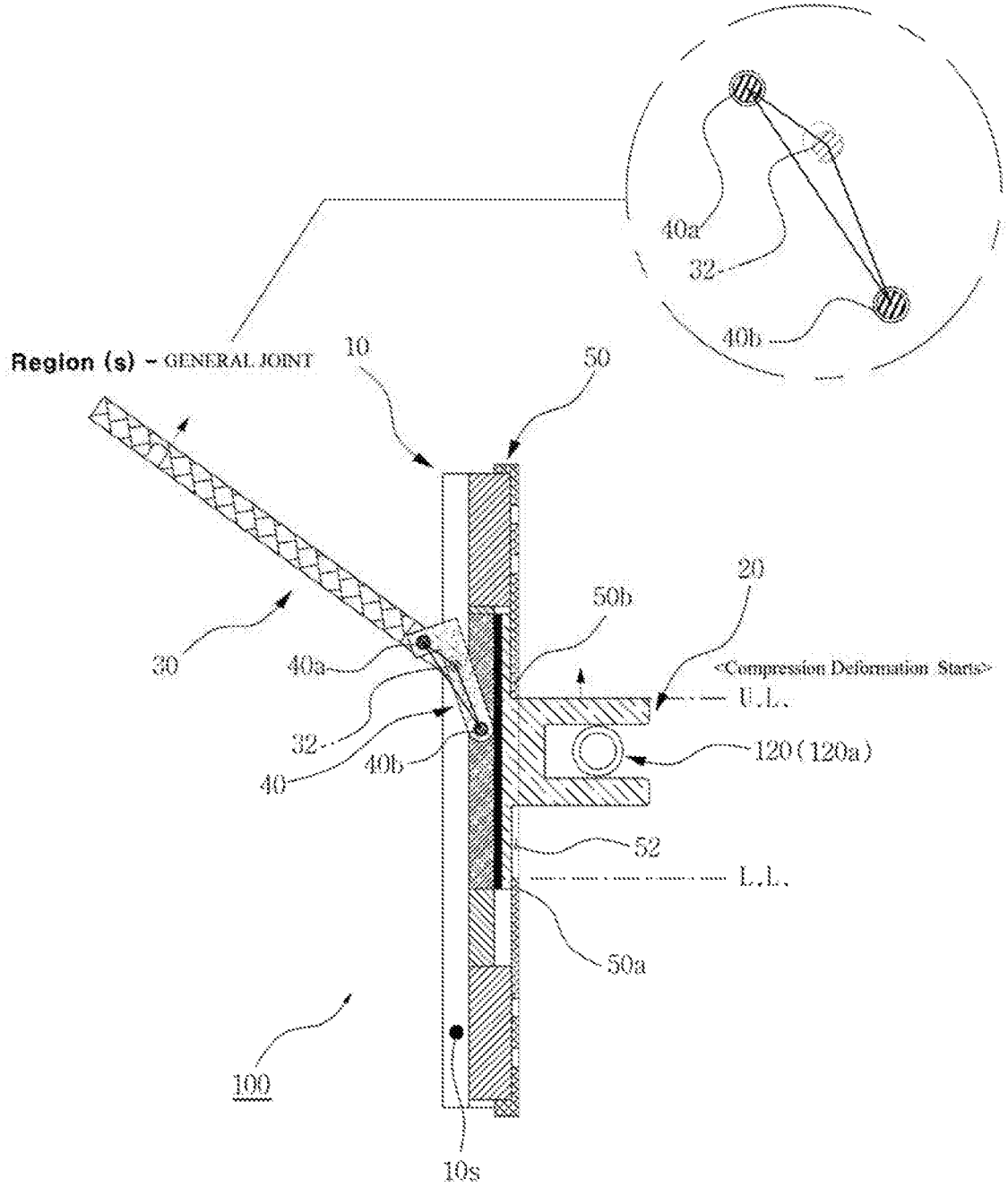
Figure 6D:
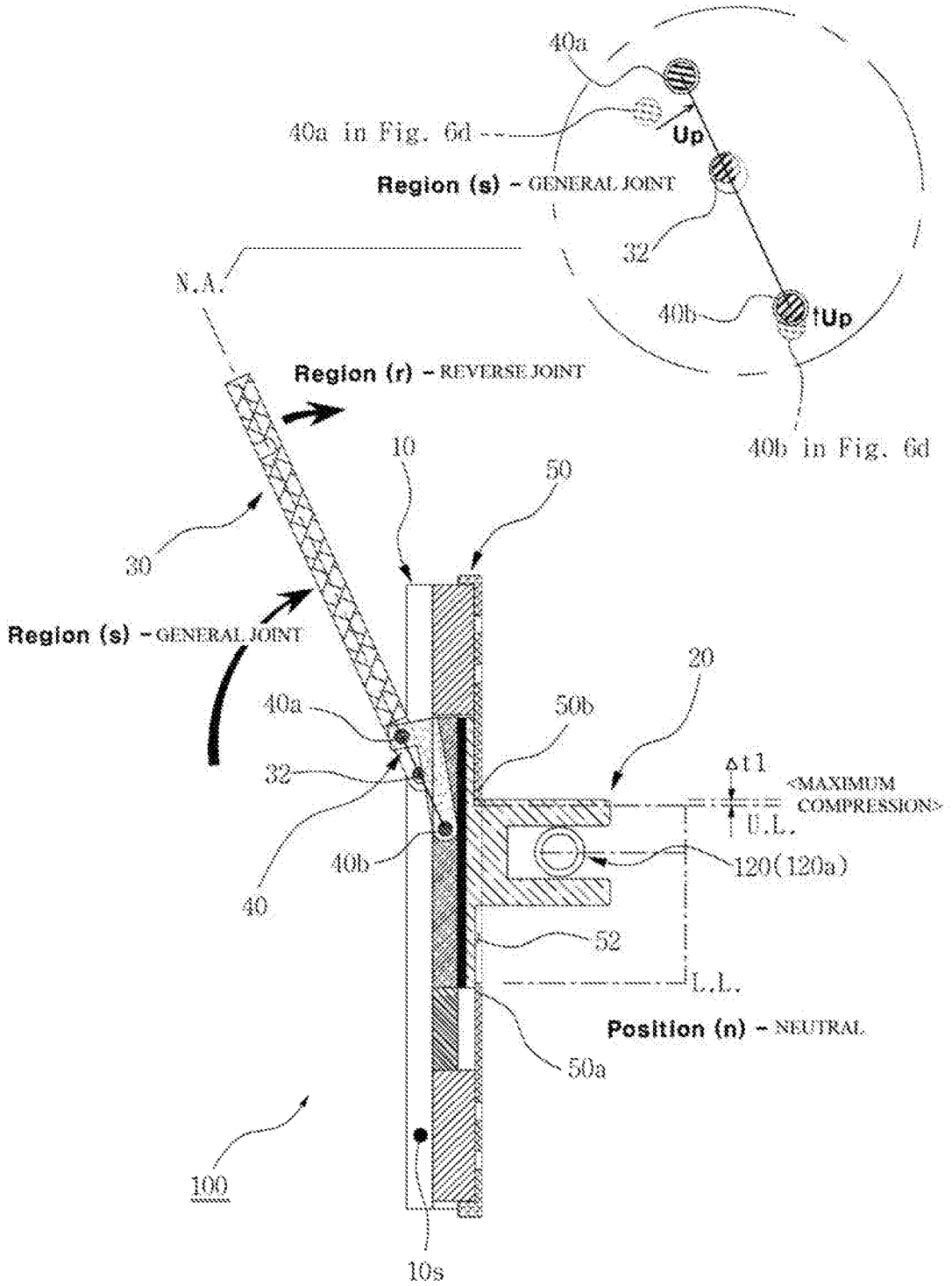
Figure 6E:
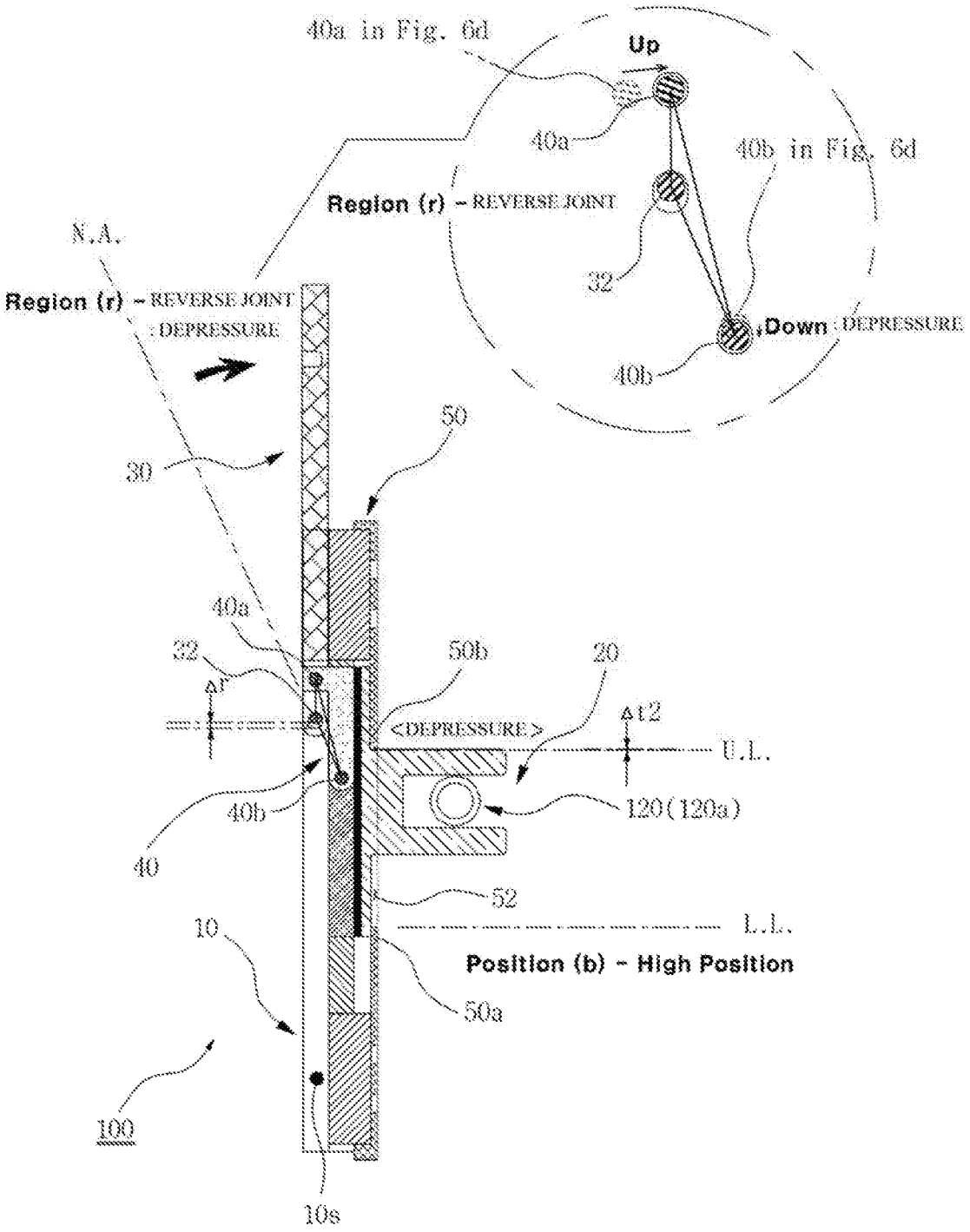

FIGS. 4A and 6A show a state in which the rotatable lever 30 composing the switching device 100 is installed by the first hinge pin 32 to rotate from a front surface of the housing 10 in a longitudinal direction and rotates downward to be fixed to the lowermost side (−90° from a horizontal surface). In this case, when the rotatable lever 30 rotates upward about the first hinge pin 32, the above-described state is changed to a state shown in FIG. 4B, and when a further upward rotation is performed, as shown in FIGS. 4C and 6B (0° from a horizontal surface) and FIGS. 4D, 6C, and 6D, one end portion of the conversion link bar 40 is connected with the second hinge pin 40*a* at a predetermined position between the first hinge pin 32 of the rotatable lever 30, and the other end portion thereof is connected by the third hinge pin 40*b*, and thus the sliding block 20 slides upward in the housing 10 according the upward rotation operation of the rotatable lever 30. As shown in FIGS. 4E and 6E, the rotatable lever 30 rotates upward from the front surface of the housing 10 to be fixed to the uppermost side (+90° from a horizontal surface).

Further, according to one exemplary embodiment of the present invention, a unit for maintaining the second pressure roll 120*b* to be fixed to the contact compressed state position (for example, a uppermost rotated state) with the close contact guide plates 130 or a noncontact uncompressed state position (for example, a lowermost rotated state) is required. For example, a rotatable lever releasing blocking unit for blocking release of the rotatable lever 30 before external force greater than a predetermined strength is applied to the rotatable lever 30 to rotate the rotatable lever 30 in a reverse direction while in the lowermost rotated state (−90° from a horizontal surface) and the uppermost rotated state (+90° from a horizontal surface, see FIG. 4E) is additionally provided for the switching device 100.

In this case, according to one exemplary embodiment of the present invention, the first rotation lever releasing blocking unit, which is one of the rotatable lever releasing blocking units, is provided to maintain the uppermost rotated state (a position (b) of FIG. 6E, a high position state). In this case, as shown in FIGS. 4B, 4C, 6B, 7B, and 7C, while the rotatable lever 30 composing the switching device 100 rotates upward about the first hinge pin 32 so that the second hinge pin 40*a* is positioned above the first hinge pin 32 (section [A] operation of the rotatable lever shown in FIG. 4D; regular joint represented as regions in FIGS. 6D, 6C, 6D, 7B, and 7C), as shown in FIGS. 4D, 6D, and 7D, the third hinge pin 40*b*, the first hinge pin 32, and the second hinge pin 40*a* are in a neutral state N.A. to be disposed in a sequentially upwardly inclined straight line. As shown in FIGS. 6C and 7C, a sliding guide groove upper limit line U.L. is set at a position limiting additional free upward movement of the sliding block 20 and the slider fork 25 before the neutral state N.A., and the compression deformation of the upper region 50*b* of the cover plate 50 starts (represented as 'deformation starting point' in FIG. 7C) so that additional upward movements of the sliding block 20 and the slider fork 25 are elastically received (the sliding block 20 and the slider fork 25 move upward to a neutral position—a position (n) of FIG. 6D) through elastic compression deformation (maximum compression deformation of FIG. 6D=Δt1; '0.619 mm' of FIG. 7D showing the embodiment) of the upper region 50*b* of the cover plate 50 induced by an upward displacement exceeding the sliding guide groove upper limit line U.L. while the rotatable lever 30 moves upward to the neutral state N.A. of FIGS. 4D, 6D, and 7D. As shown in FIGS. 4E, 6E, and 7E, in a section in which the rotatable lever additionally rotates upward until the vertically upright state (a uppermost rotated state; +90° from a horizontal surface) beyond the neutral state, the sliding block 20 and the slider fork 25 connected to the link bar 40 through the third hinge pin 40*b* is moved slightly downward (the third hinge pin 40*b* connected by the conversion link bar slides downward rather than upward in a section in which the second hinge pin 40*a* rotates upward about the first hinge pin 32 according to a kinematic structure of the hinge pin link, which is represented as a reverse joint, a section [B] operation of the rotatable lever shown in FIG. 4D; the sliding block 20 and the sliding fork 25 slightly move downward to a high position—a position (b) of FIG. 6E) by the elastic recovery deformation (depressure; compression deformation=Δt2<Δt1; 0.1 mm of FIG. 7E schematically showing a device of the embodiment in which the rotation diameter a from the first hinge pin to the projection is 83 mm) of the upper region 50*b* of the elastically pressed cover plate 50, through the elastic compression deformation (Δt1 of FIG. 6F; '0.619 mm' of FIG. 7F schematically showing a device of the embodiment in which rotation diameter a from the first hinge pin to the catching projection is 83 mm) of the upper region 50*b* of the cover plate 50 caused when the sliding block 20 and the sliding fork 25 for recovering the slight downward movement (consequentially, the upper region 50*b* of the cover plate 50 is uncompressed) caused during the upward rotation process slightly move upward, until external force F strong enough to be re-performed as shown in FIGS. 6F and 7F is applied to the rotatable lever 30, a reverse operation of the sliding block 20, and the slider fork 25 integrated with the sliding block 20 (section [B] operation of the rotatable lever shown in FIG. 4E, downward rotation of the rotatable lever shown in FIGS. 6F and 7F, and downward movement of the sliding block and the slider fork integrated with the sliding block; that is release of the rotatable lever 30), is limited.

Figure 6F:
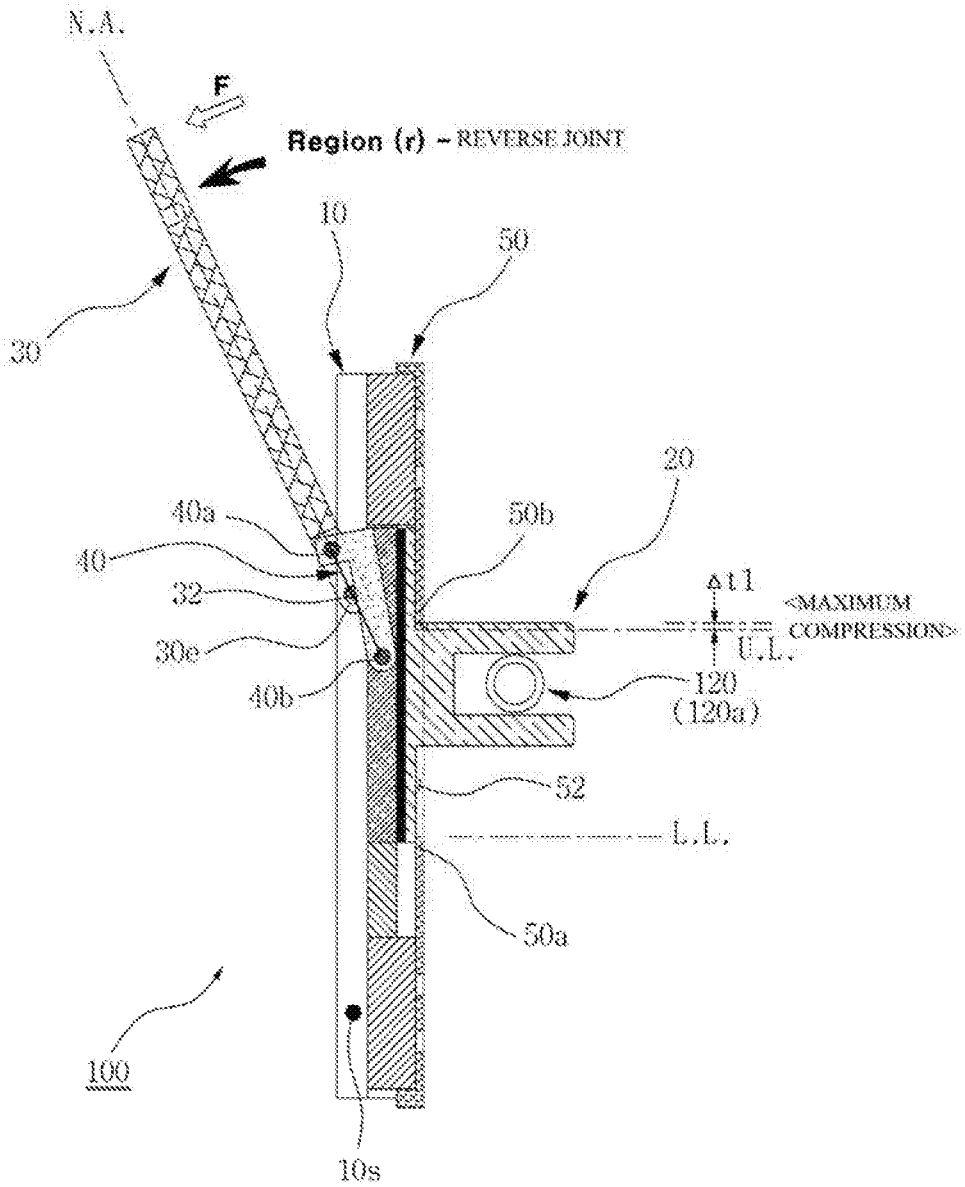
FIG. 6F is a cross-sectional view showing a state in which an upwardly fixed state of the sliding block and the slider fork is released by the reverse operation of the rotatable lever in the upwardly fixed state of the sliding block and the slider fork (a contact compressed state, a compressed/locked state).
Figure 7A:
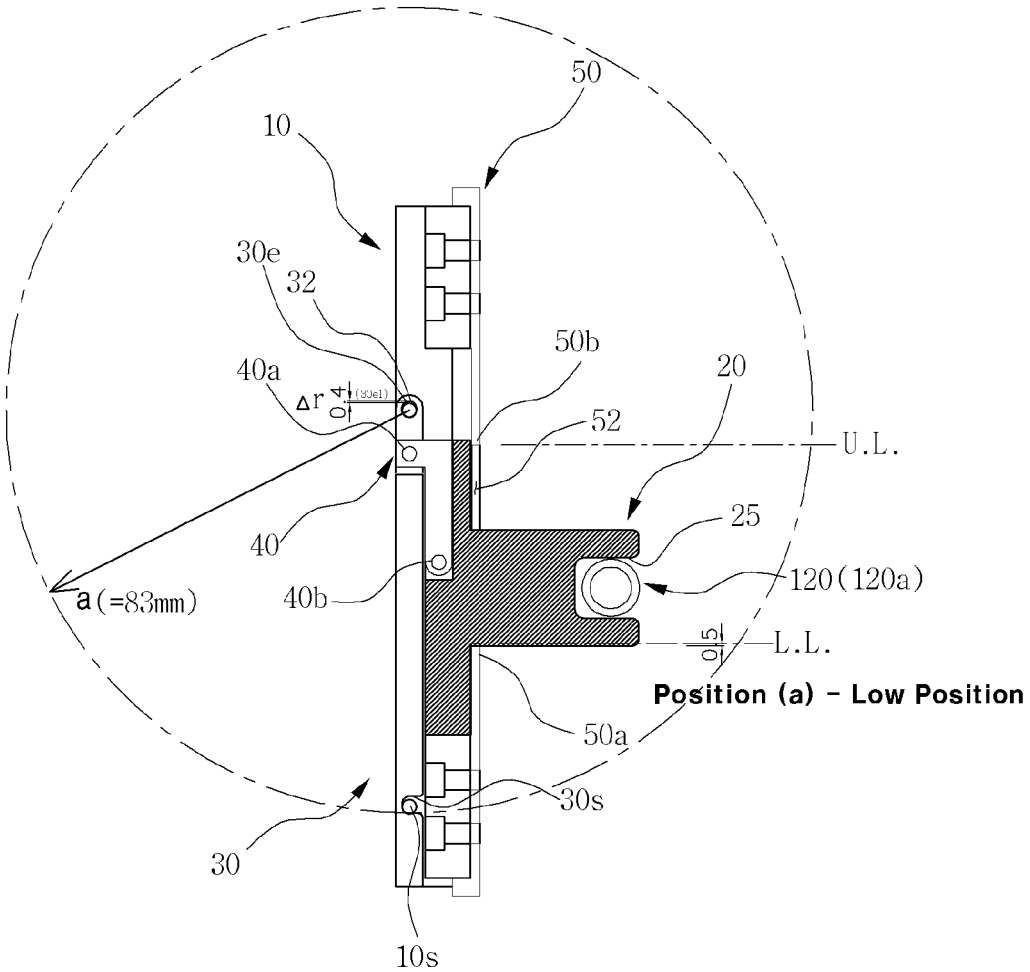
FIGS. 7A to 7E are cross-sectional views schematically showing processes of an operation state in which a contact-compressed state (a compressed/locked state) is achieved by rotating the rotatable lever upward to move the sliding block and the slider fork upward while the locking device of a hinged door according to the present invention is installed on one side of the door frame.
Figure 7B:
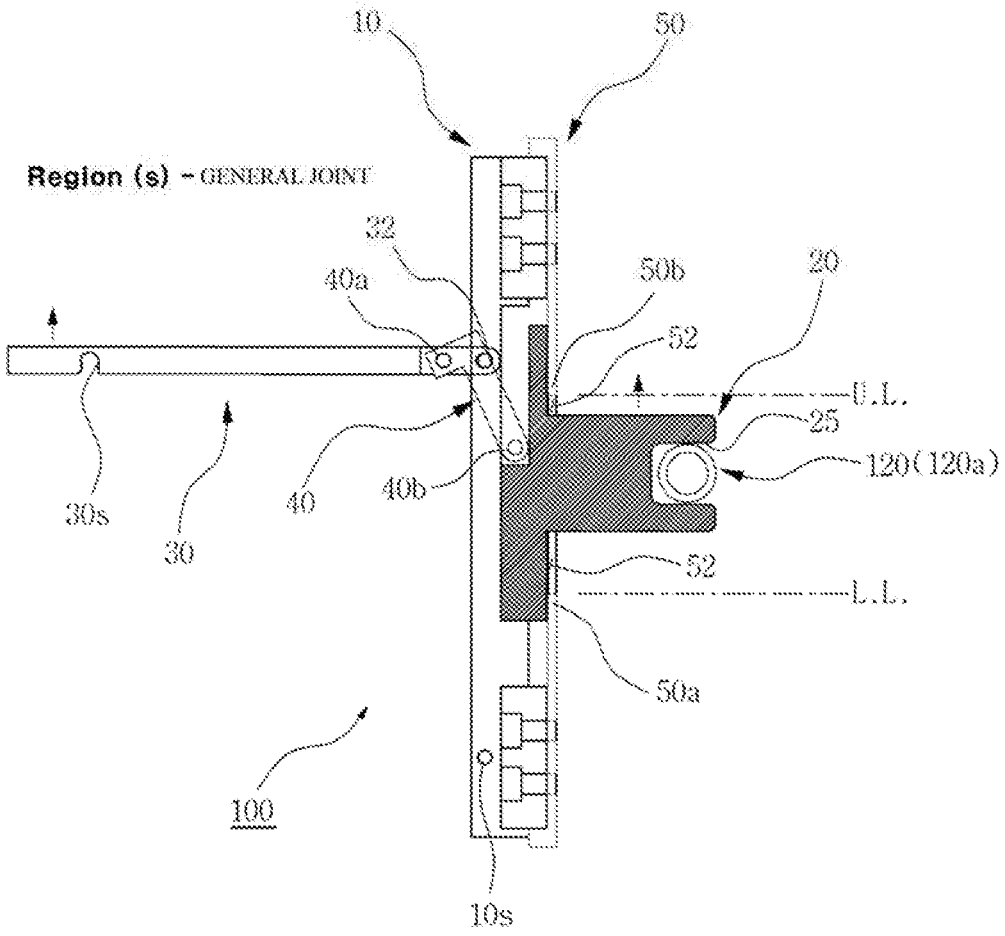
Figure 7C:
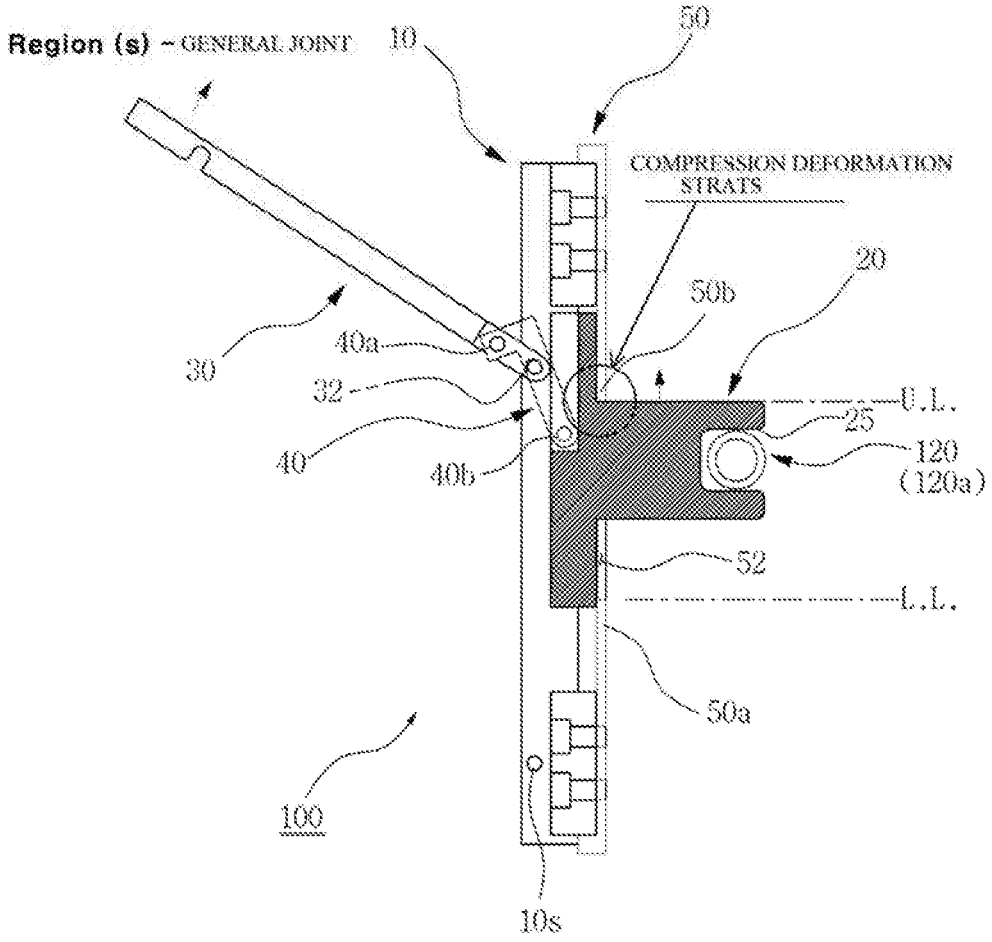
Figure 7D:
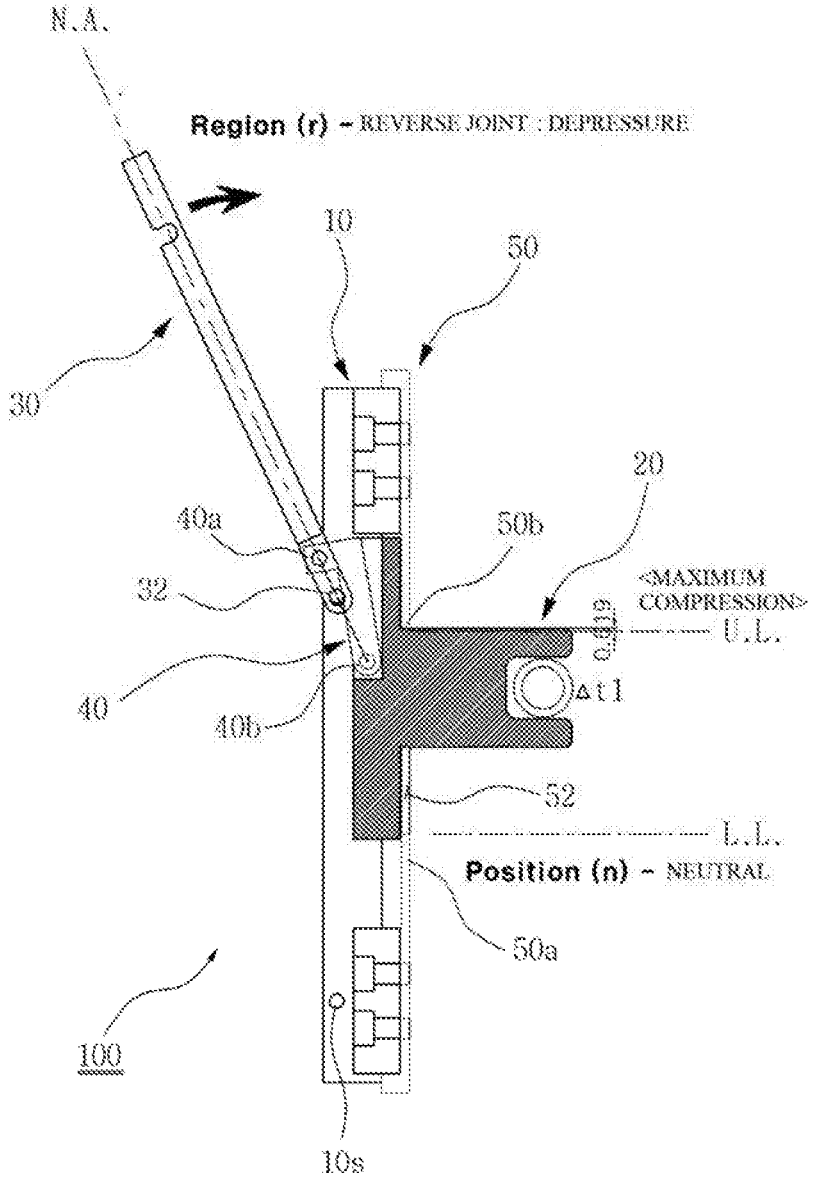
Figure 7E:
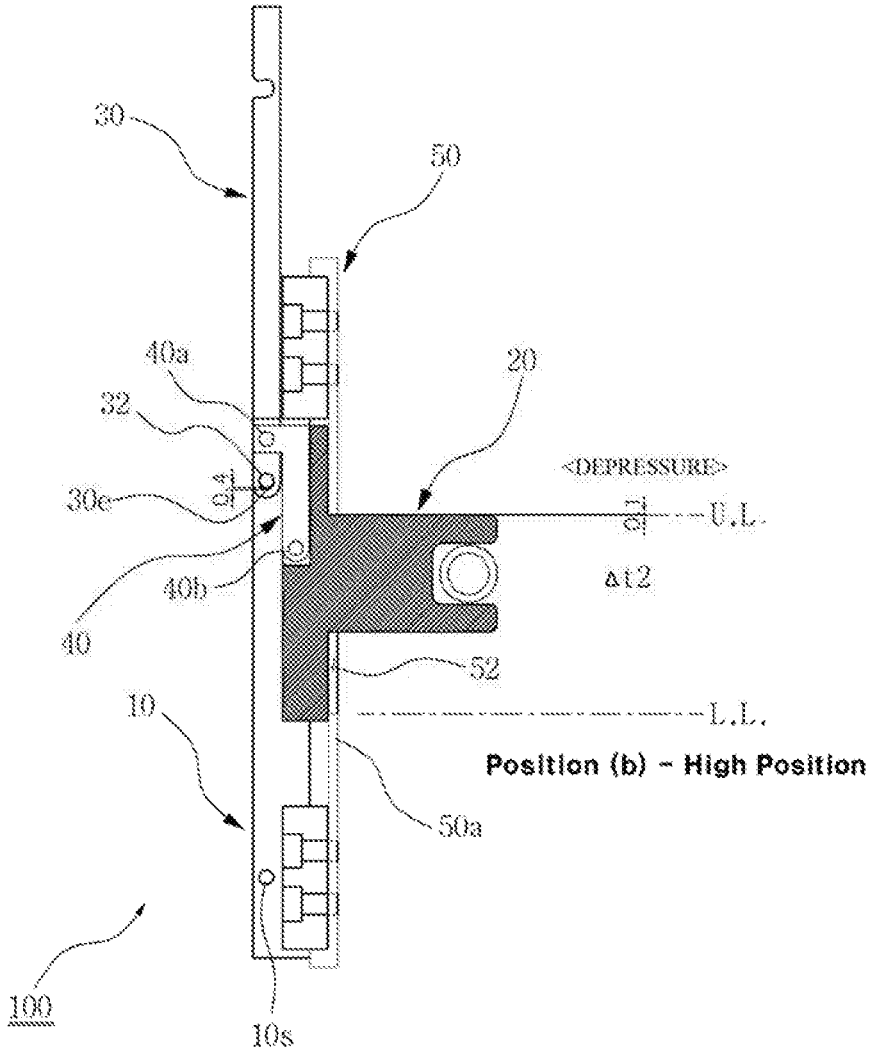
Figure 7F:
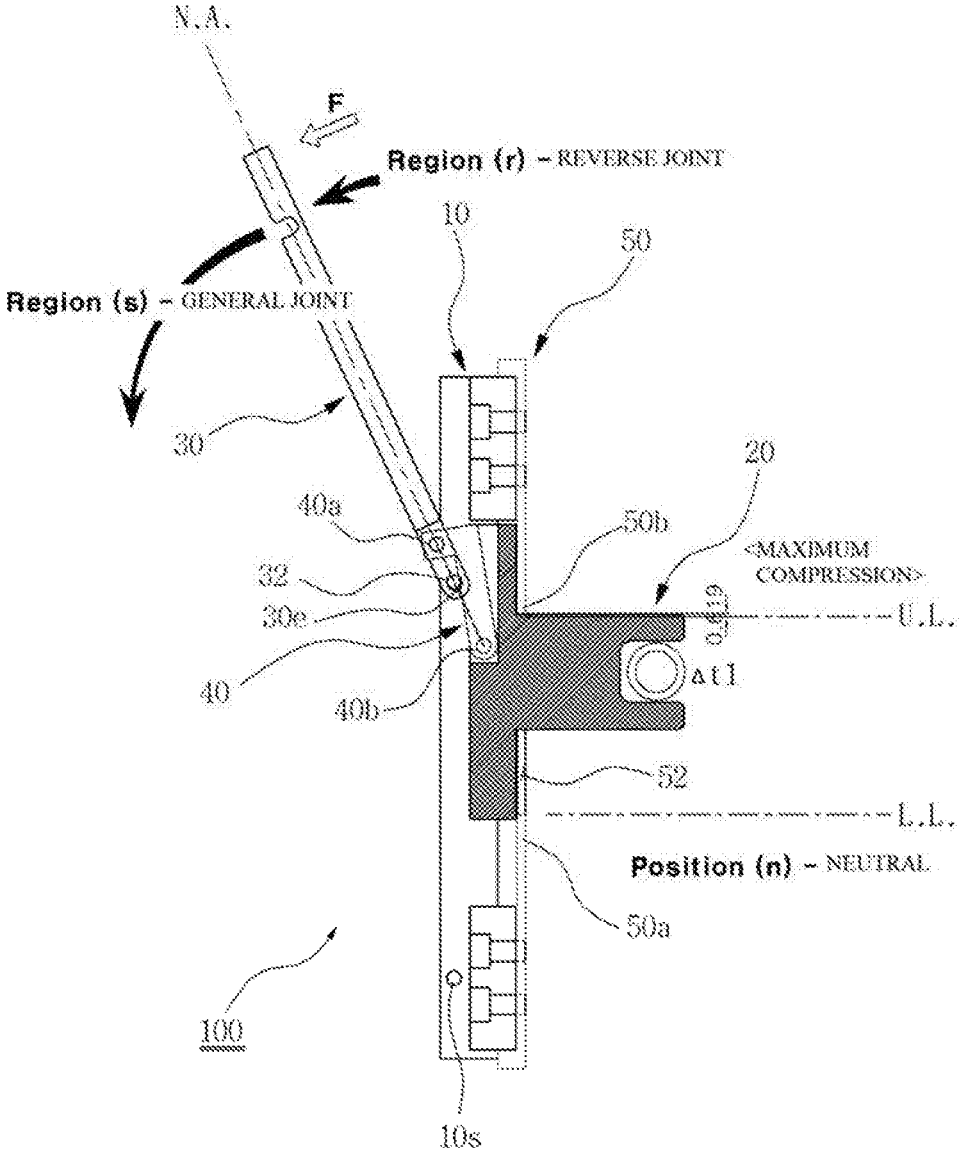
FIG. 7F is a cross-sectional view schematically showing that an upwardly fixed state of the sliding block and the slider fork is released by a reverse operation of the rotatable lever in an upwardly fixed state (a contact-compressed state, a compressed/locked state) of the sliding block and the slider fork.

That is, in a state in which the sliding block 20 and the slider fork 25 are in an upwardly fixed state (a contact compressed state, a compressed/locked state), to release the state in which the sliding block 20 and the slider fork 25 are in an upwardly fixed state by a reverse operation of the rotatable lever 30, the reverse strong external force F is applied to the rotatable lever 30 as shown in FIGS. 6F and 7F, and thus a fixed state is stably maintained.

Further, a sliding guide groove upper limit line U.L. of the sliding guide groove 52 is set at a predetermined position of the upper region 50*b* of the cover plate 50 made of the elastic material, and the appropriate strength of the external force required for locking or unlocking to be applied to the rotatable lever 30 is set, and thus the first rotatable lever releasing blocking unit is provided.

Figure 5A:
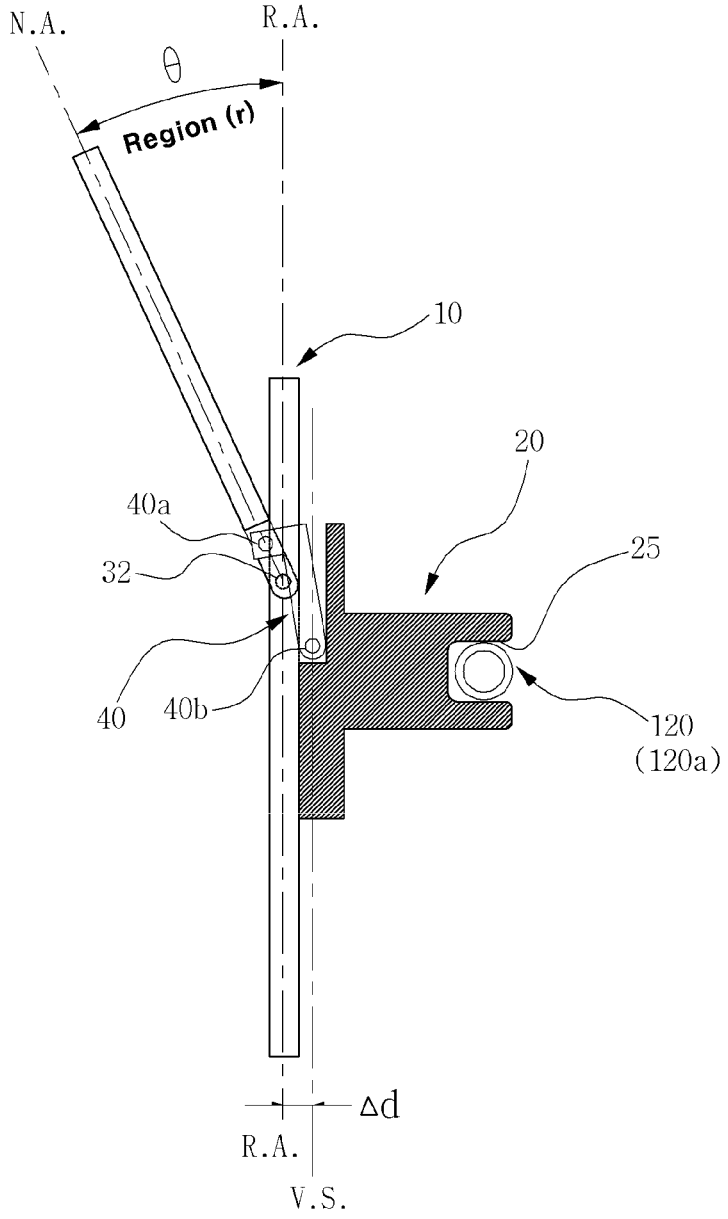
FIGS. 5A and 5B are views for describing necessity of a rotatable lever rotation blocking unit for blocking a reverse operation of the rotatable lever to maintain the pressure roll to be fixed at a contact compressed state (a compressed/blocked state) position with the close contact guide plate or a noncontact uncompressed state (a uncompressed/locked state) position in a switching device composing the locking device of a hinged door according to the present invention.
Figure 5B:
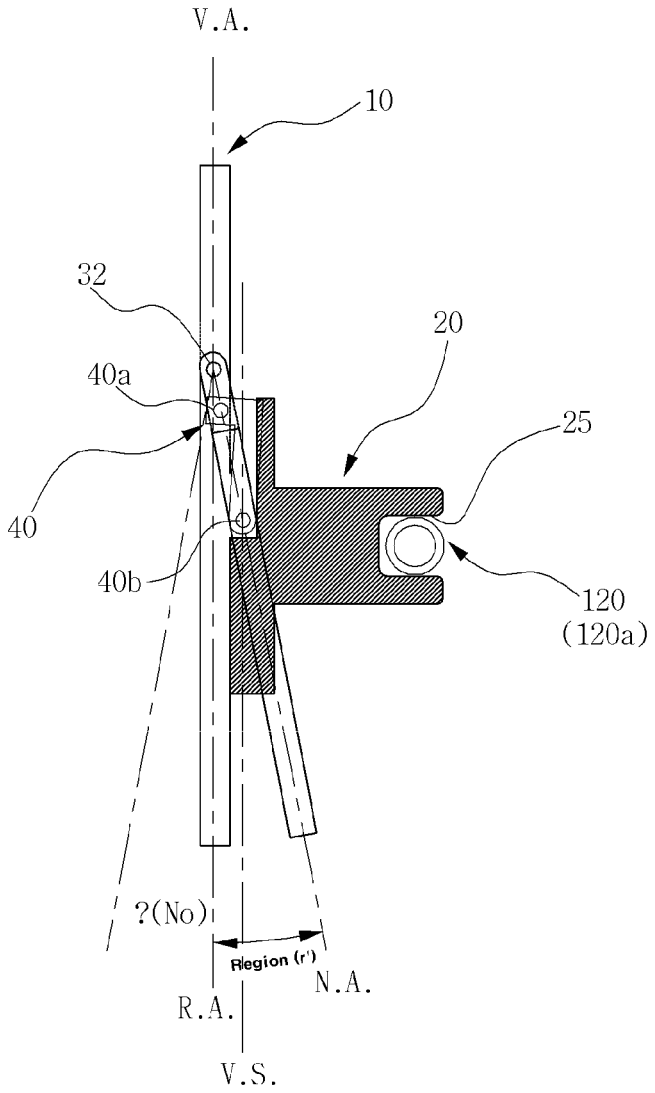

Meanwhile, the rotatable lever releasing blocking unit is required even in a section in which the rotatable lever 30 rotates about the first hinge pin 32 downward to reach a vertically downward state, as shown in FIG. 5A, and thus, due to a structure in which an installation axis planar surface (R.A.) of the first hinge pin 32 is disposed in front of an installation axis planar surface (V.S.) of the third hinge pin 40*b* connected with the sliding block 20, that is, is disposed in front of a longitudinal linear sliding axis planar surface of the third hinge pin 40*b* by Δd (see FIG. 5A) (that is, a structure in which a neutral state in which three hinge pins are in a straight line is inclined by an angle θ), in a section in which the rotatable lever 30 rotates about the first hinge pin 32 upward to reach a vertically upright state, a neutral state N.A. is formed on a front surface of the housing 10 so as to form a reverse joint region r. On the contrary, in a section in which the rotatable lever 30 rotates about the first hinge pin 32 downward, a neutral state N.A. is not formed on a front surface of the housing to reach a vertically downward state (as shown in FIG. 5B, a virtual downward neutral state N.A. and a virtual reverse joint region r' are formed on a rear surface of the housing beyond the vertically downward state). Therefore, there is a need to use the rotatable lever releasing blocking unit in another structure.

To solve the problem, in the exemplary embodiment of the present invention, a lowermost rotated state of the second rotatable lever releasing blocking unit, which is another one of the rotatable lever releasing blocking units, is provided to maintain a lowermost rotated state (a low position state—a position (a) of FIG. 6A), and as the second rotatable lever releasing blocking unit, the rotatable lever 30 composing the switching device 100 rotates about the first hinge pin 32 downward to a vertically downward state from FIG. 7G to FIG. 7J so that the second hinge pin 40*a* is positioned below the first hinge pin 32, and thus the first hinge pin 32, the second hinge pin 40*a*, and the third hinge pin 40*b* are disposed downward sequentially in a triangular structure. A sliding guide groove lower limit line L.L. is set at a position limiting additional free downward movements of the sliding block 20 and the slider fork 25 before the vertically downward state, and thus a further downward movement of the sliding block 20 and the slider fork 25 is elastically received by elastic compression deformation of the lower region 50*a* of the cover plate 50 induced by a downward displacement exceeding the sliding guide groove lower limit line L.L. while the rotatable lever 30 rotates downward to reach the vertically downward state, and the lever downward moving unit and the lever recovery unit may be provided between the housing 10 and the rotatable lever 30 to induce the rotatable lever 30 to forcibly induce additional slight downward movement and recovery of the rotatable lever 30 while the rotatable lever 30 rotates downward to the vertically downward state beyond the sliding guide groove lower limit line L.L. state in which free downward movements of the sliding block 20 and the slider fork 25 are limited. Therefore, the reverse operations (upward rotation and upward movement) of the rotatable lever 30, the sliding block 20, and the slider fork 25 integrated with the sliding block 20 are limited by the rotatable lever 30 rotated from the lever recovery unit to the opposite direction through the lever downward moving unit until elastic compression deformation of the cover lower region 50*a* is re-performed by forcible further slight downward movement of the rotatable lever 30.

In this case, as described above, the lever downward moving unit includes a catching protrusion 10*s* protruding from a side wall of the housing 10, a catching projection 30*sa* provided on an entrance portion of the catching groove 30*s* formed on a side surface of the rotatable lever 30 to be concave to correspond to the catching protrusion 10*s*, and a long hole portion 30*e*, which is a hinge hole of the rotatable lever 30 to which the first hinge pin 32 is fastened to receive downward movement of the rotatable lever 30 performed when the catching projection 30*sa* comes out of a lower end portion of the catching protrusion 10*s*, including a vertical gap Δr for the first hinge pin 32, and the lever recovery unit includes a catching protrusion expanded mounting portion 30*se* provided in the catching groove 30*s* to receive elastic recovery deformation of the cover plate-lower region 50*a*.

Figure 4B:
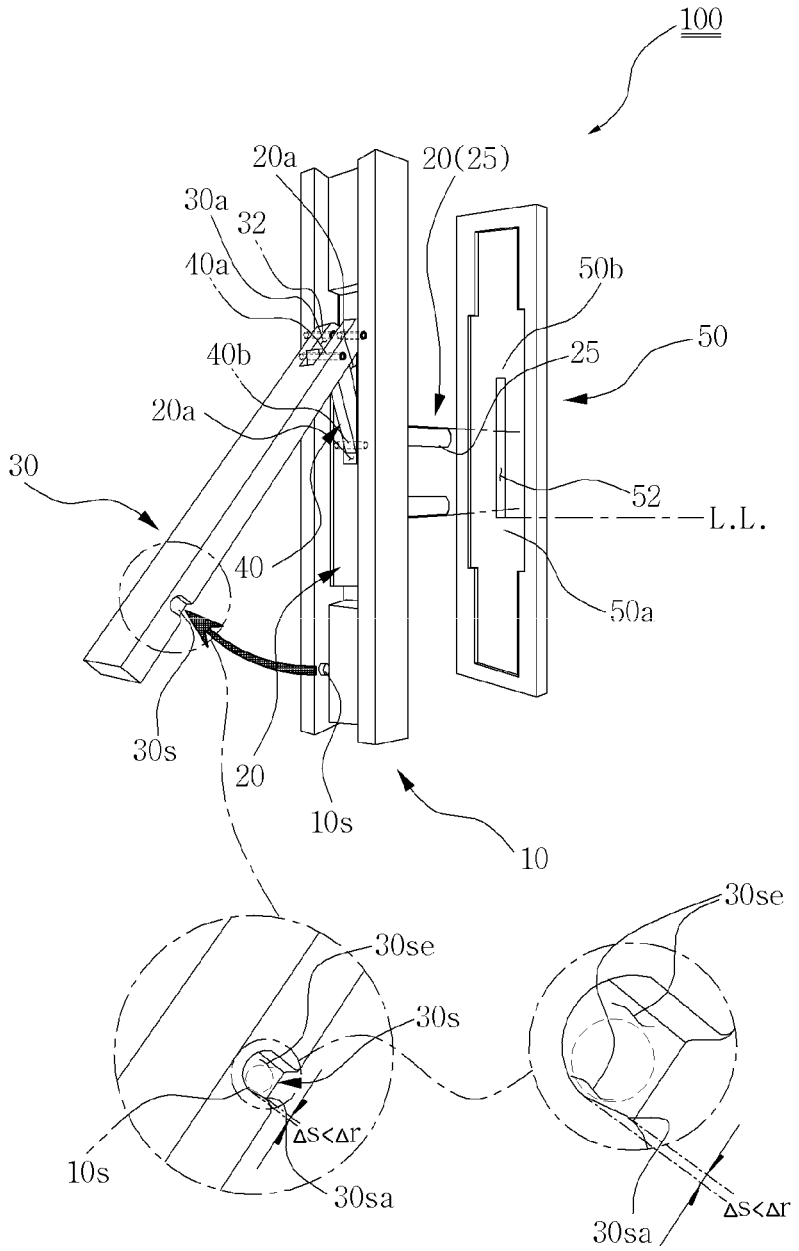
Figure 4C:
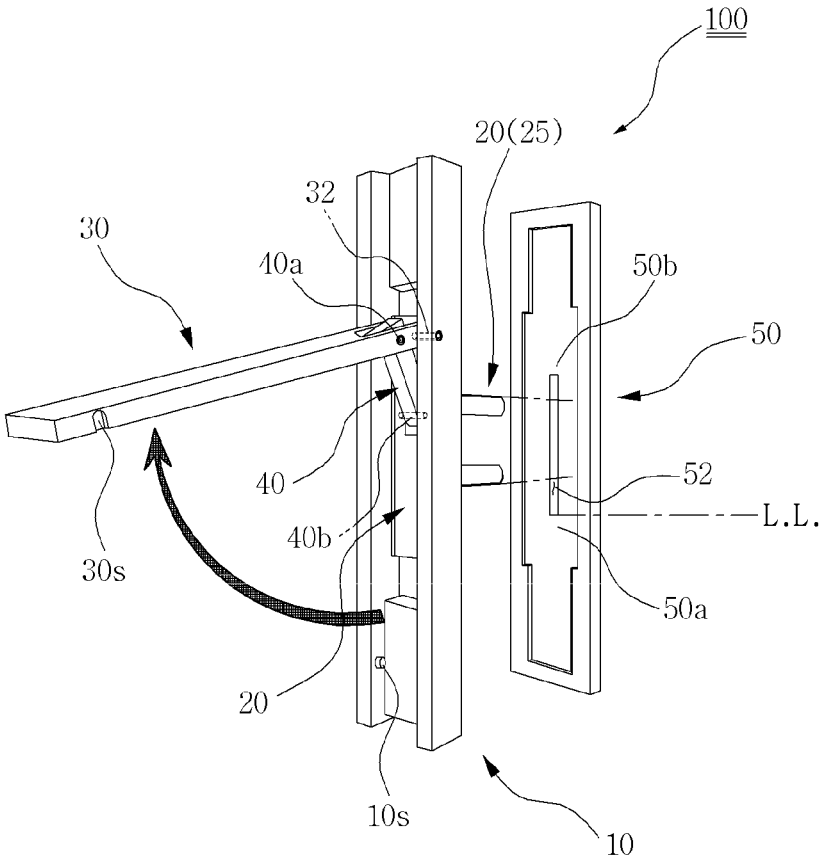
Figure 4D:
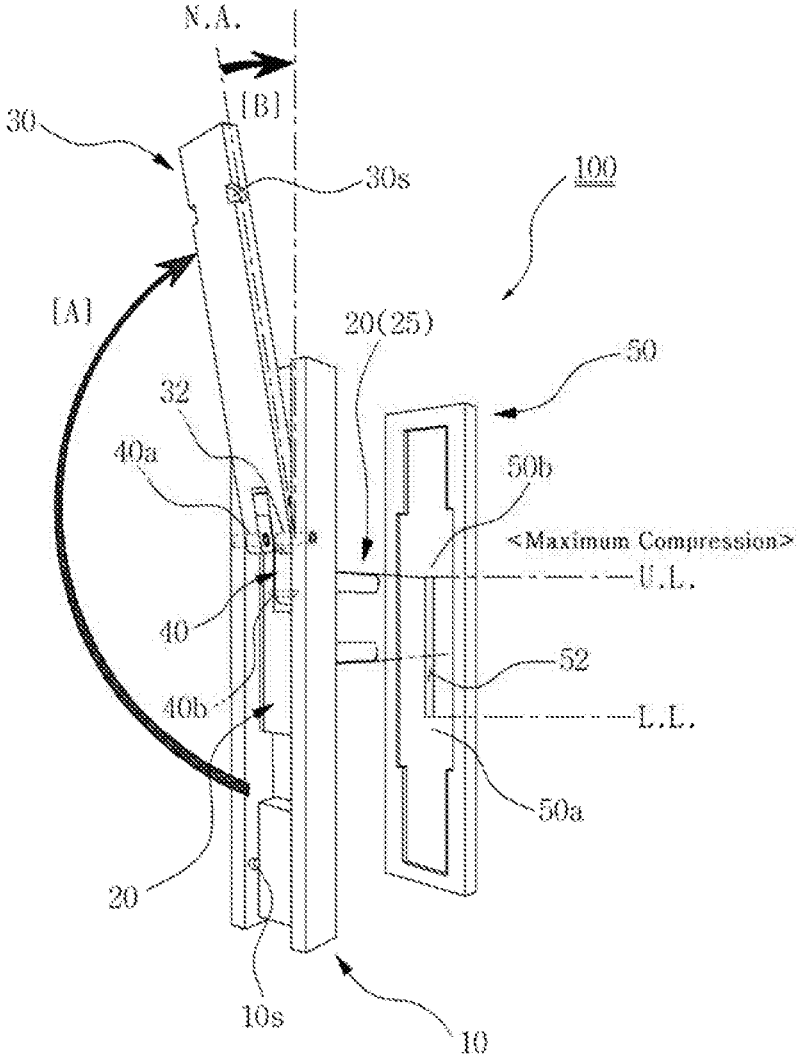
Figure 4E:
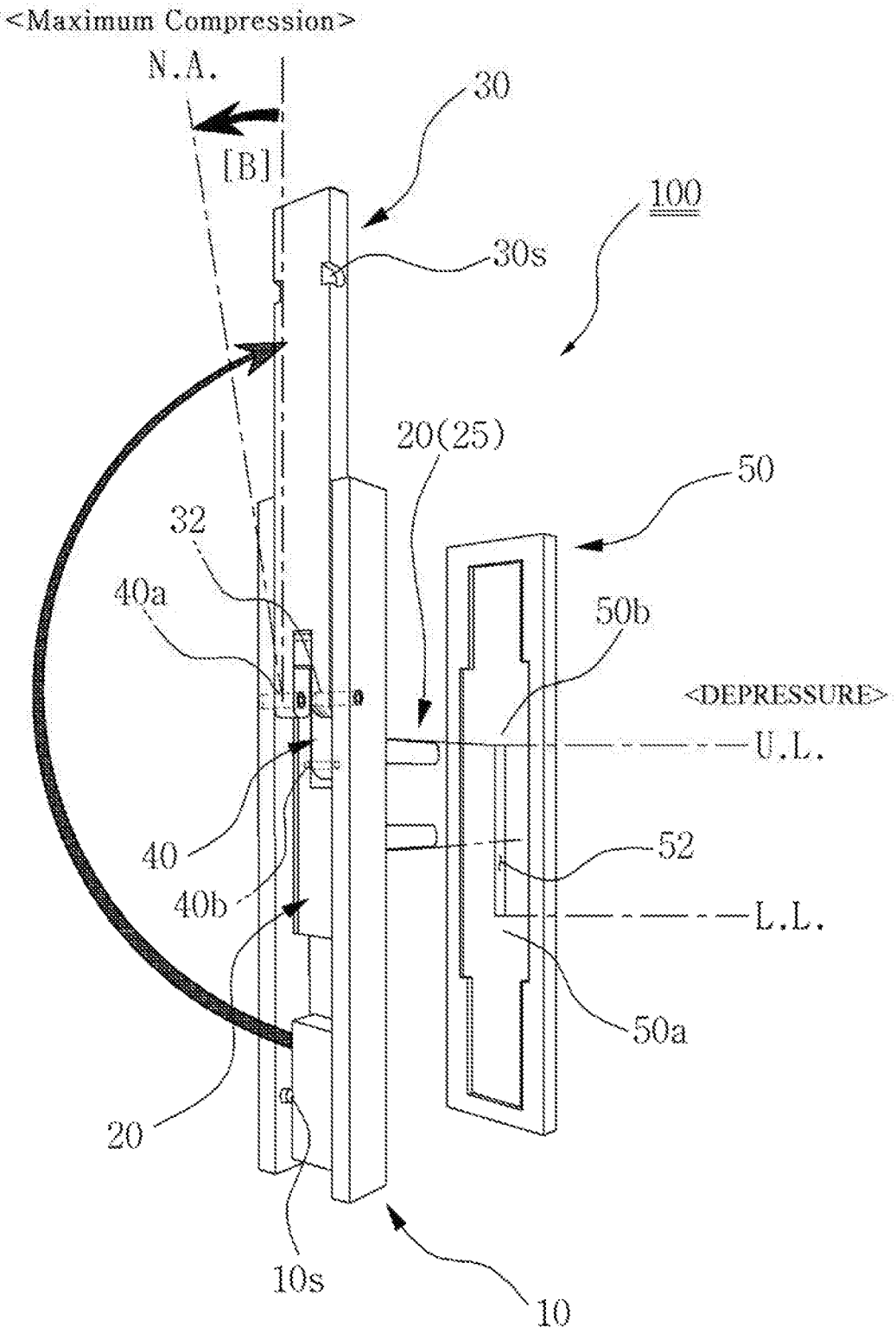
Figure 7G:
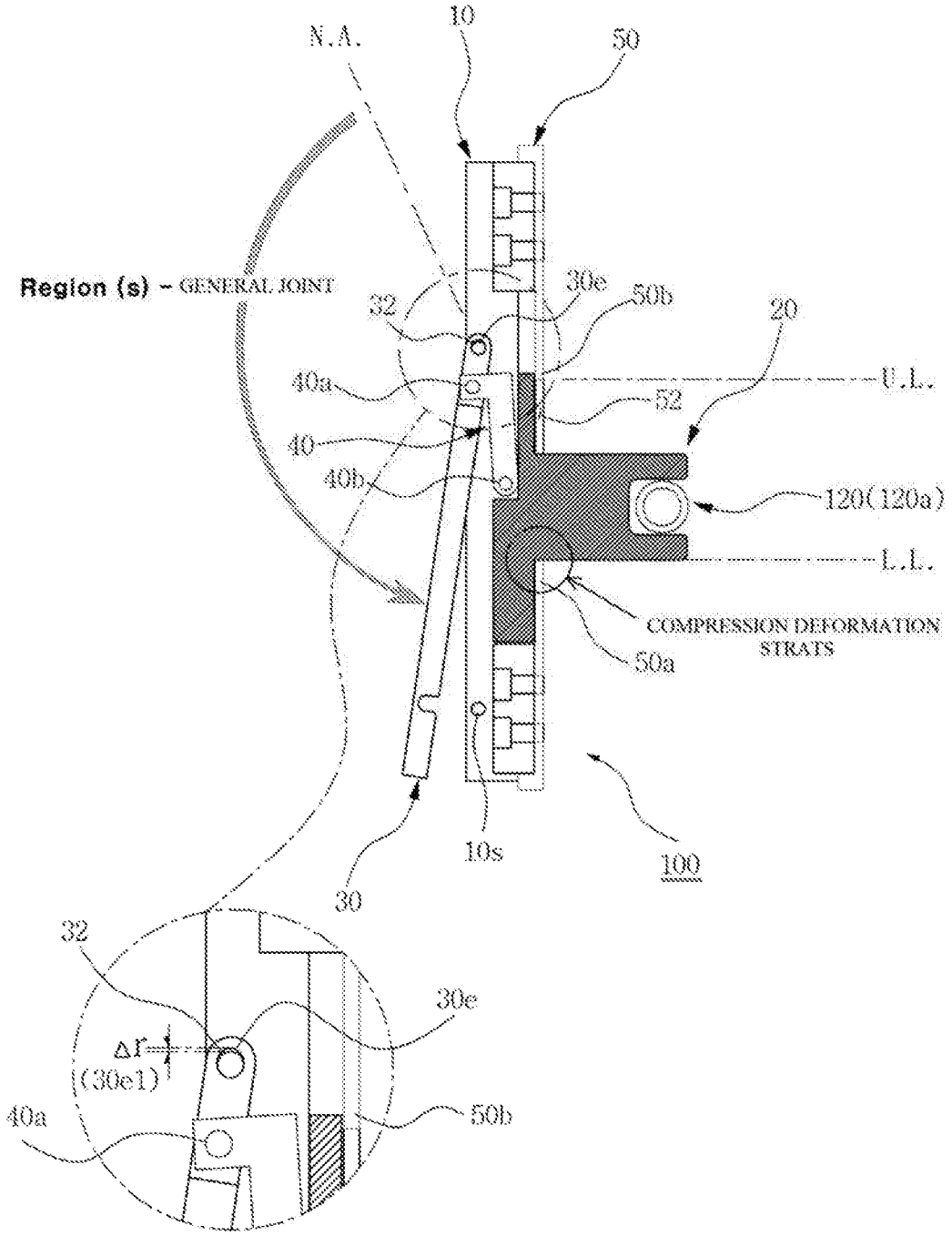
FIGS. 7G to 7J are cross-sectional views schematically showing processes in which the sliding block and the slider fork reach a downwardly fixed state (a noncontact uncompressed state is maintained, a uncompressed/locked state) by rotating the rotatable lever downward, and the downwardly fixed state is maintained.
Figure 7H:
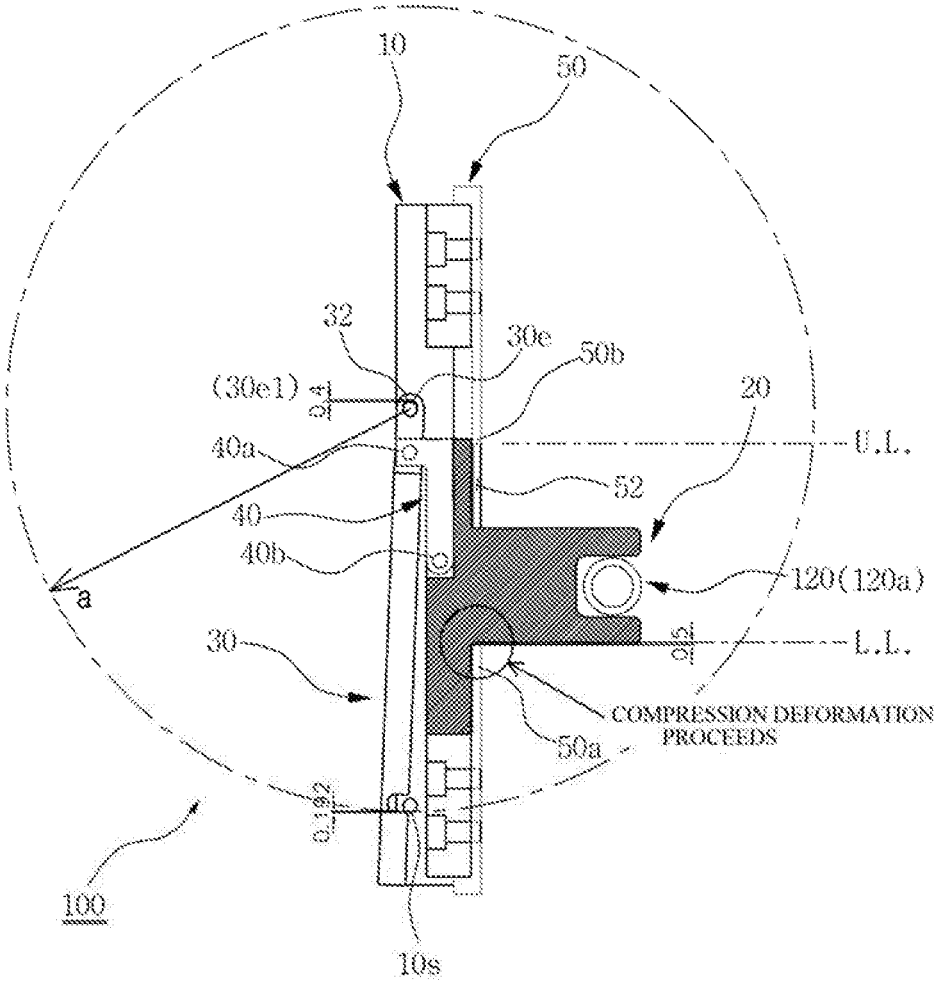
Figure 7I:
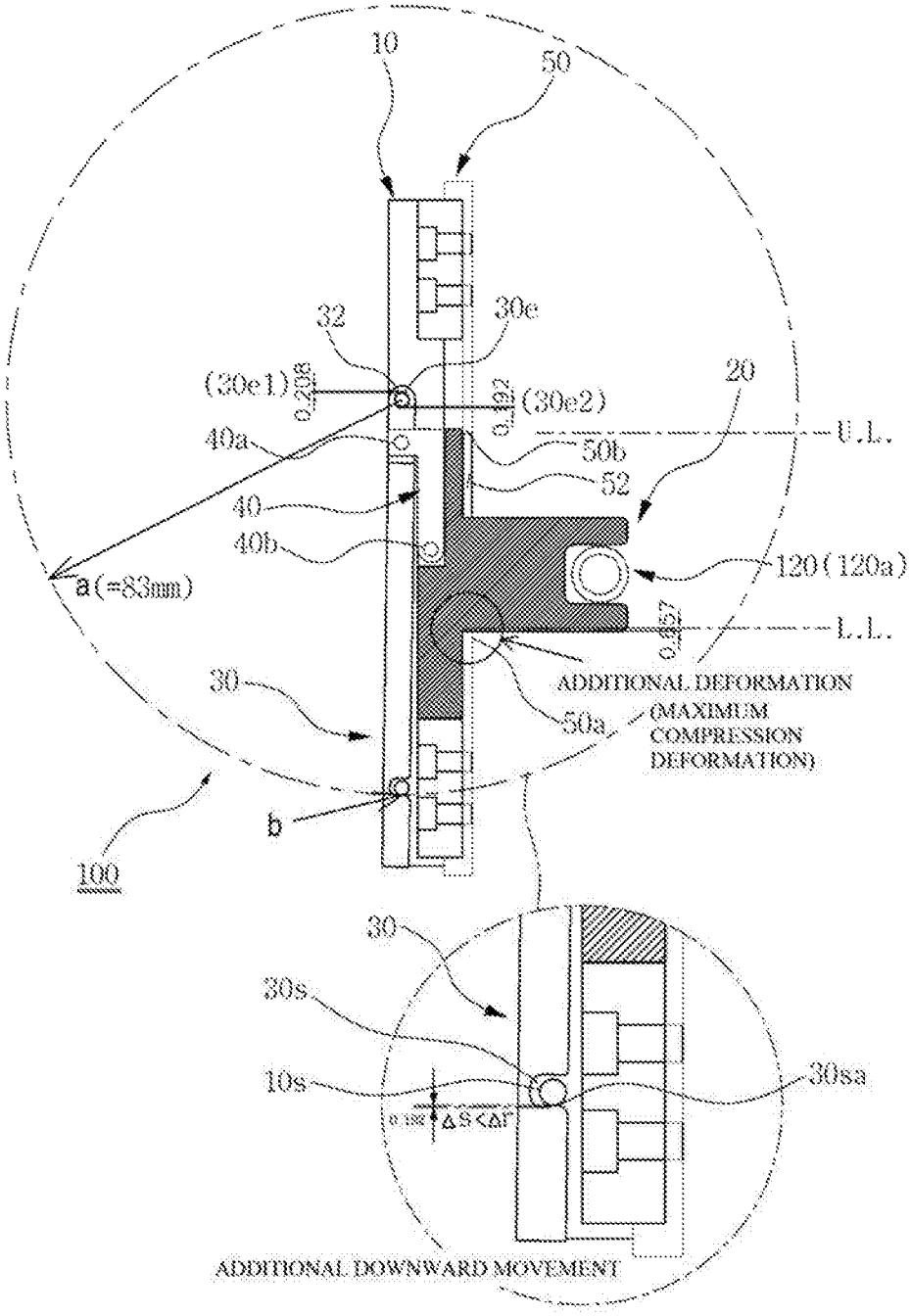
Figure 7J:
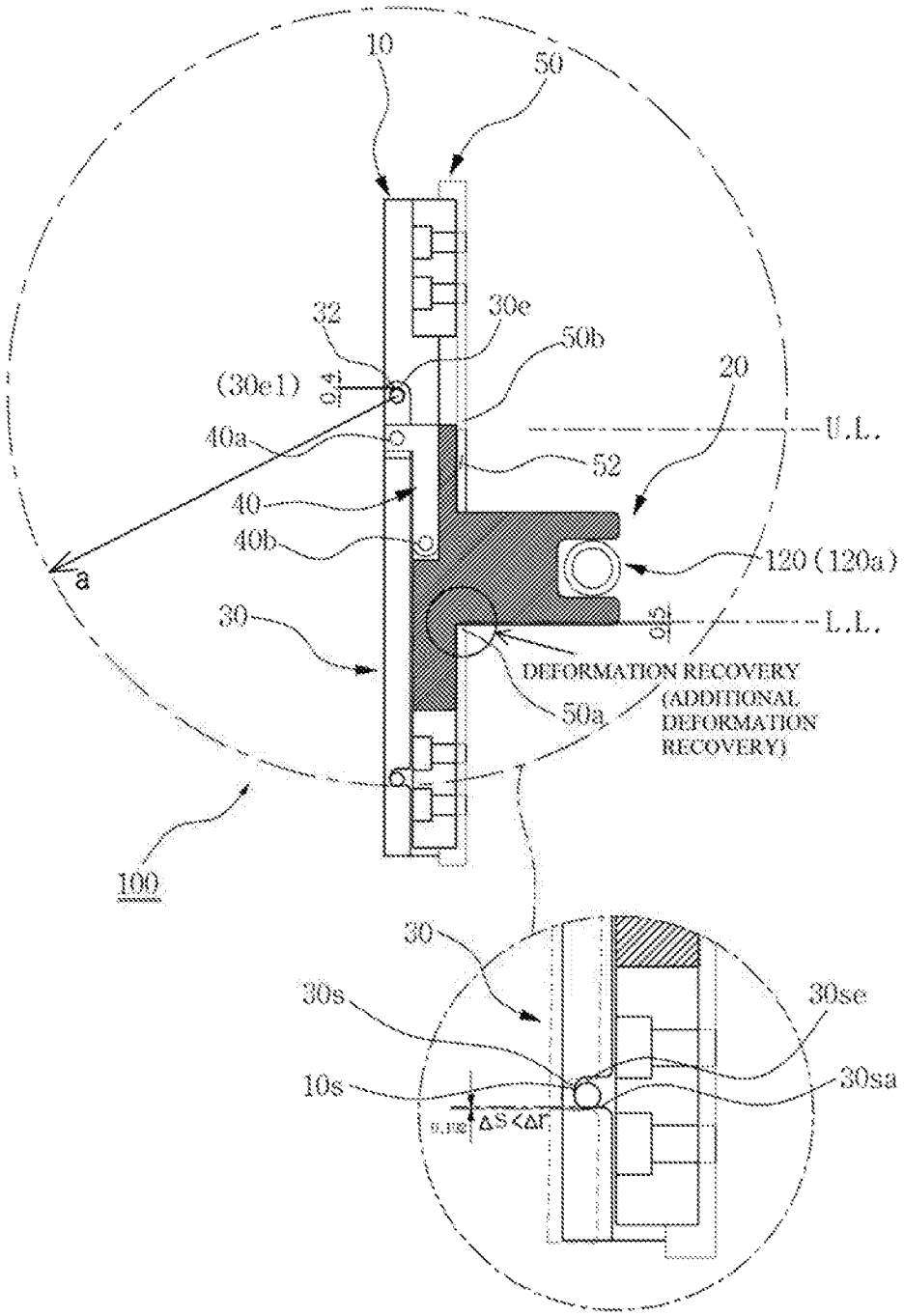

In this case, the vertical gap Δr of the long hole portion 30*e* may be greater than a height Δs of the catching projection 30*sa* (see FIGS. 4B, 6A, and 7J).

Hereinafter, specific operation processes of the lever downward moving unit and the lever recovery unit will be described in more detail with reference to FIGS. 7G to 7K.

As shown in FIG. 7G, the rotatable lever 30 composing the switching device 100 rotates downward about the first hinge pin 32 so that the second hinge pin 40*a* is positioned below the first hinge pin 32, and the first hinge pin 32, the second hinge pin 40*a*, and the third hinge pin 40*b* are disposed downward sequentially in a triangular structure. When the rotatable lever 30 reaches the sliding guide groove lower limit line L.L. (a deformation starting point), which is a position limiting additional free downward movements of the sliding block 20 and the slider fork 25 before the vertically downward state, a downward displacement exceeding the sliding guide groove lower limit line L.L. is achieved by the elastic compression deformation ('0.5 mm' deformation of FIG. 7H which schematically shows a device according to the embodiment in which a rotation diameter a from the first hinge pin to the catching projection 30*sa* is 83 mm) of the lower region 50*a* of the cover plate while the rotatable lever 30 moves downward to reach a process of FIG. 7H, and therefore, the additional downward movements of the sliding block 20 and the slider fork 25 are elastically received.

While in a section in which the rotatable lever 30 rotates downward to reach the vertical lower state beyond the sliding guide groove lower limit line L.L. limiting free downward movement of the sliding block 20 and the slider fork 25 (see FIGS. 7H, 7I, and 7J), forcible further slight downward movement of the rotatable lever 30, that is, the forcible further slight downward movement of the first hinge pin 32 should be induced, and thus the catching projection 30*sa* formed in an entrance portion of the catching groove 30*s* formed in a side surface of the rotatable lever 30 rotating downward to be concave is initially caught on a lower end portion of the catching protrusion 10*s* protruding from a side surface of the housing 10, and a further downward movement of the rotatable lever 30 generated when the catching projection 30*sa* at a height of Δs forcibly and additionally comes out of a lower end portion of the catching protrusion 10*s* is received in the long hole portion 30*e* including a vertical gap (Δr>Δs) for the first hinge pin 32 as a hinge hole of the rotatable lever 30 to which the first hinge pin 32 is fastened. The vertical gap shown in the long hole portion 30*e* of the hinge hole for the first hinge pin 32 is represented as an upper gap 30*e*1 and a lower gap 30*e*2 as symbols in the drawings.

Accordingly, the first hinge pin 32 additionally and forcibly moves downward by a height (As) of the protrusion of the catching projection 30*sa* determining a catching state with the lower end portion of the catching protrusion 10*s* protruding from a side wall of the housing 10, and in this case, the first hinge pin 32 moves while the upper gap 30*e*1 of the long hole portion 30*e* of the hinge hole is decreased (0.4→0.208 mm), the lower gap 30*e*2 is increased (0→0.192 mm), and the additional slight downward movement of the first hinge pin 32 induces the sliding block 20 and the slider fork 25 connected through the conversion link bar 40 connected through the second hinge pin 40*a* and the third hinge pin 40*b* connected with the other end of the conversion link bar 40 to be moved slightly further downward by additional elastic compression deformation of the lower region 50*a* of the cover plate 50 ('0.657 mm' deformation of FIG. 7I schematically showing a device according to the embodiment in which a rotation diameter a from the first hinge pin 32 to the catching projection 30*sa* is 83 mm).

When the rotation of the rotatable lever 30 is finished in the additional elastic compression state, the state becomes a unstable state due to elastic force (elastic force causing elastic recovery deformation) of the lower region 50*a* of the cover plate 50, and the lever recovery unit is provided to remove an unstable factor and maintain a stable fixed state. When the rotatable lever 30 moves slightly further downward from the above-described slight downward movement to be disposed in a downward fixed state of −90°, the catching protrusion 10*s* is mounted on the catching protrusion expanded mounting portion 30*se* through the an entrance portion for the catching groove 30*s* of the rotatable lever 30 to allow the catching projection 30*sa* with a height of Δs and a lower end portion of the catching protrusion 10*s* to be caught by elastic recovery deformation (0.657→0.5 mm) of the lower region 50*a* of the cover plate, and during the recovery, the first hinge pin 32 may move in the long hole portion 30*e* of the hinge hole upward (upward movement of the lever, that is, recovery movement of the lever) while the upper gap 30*e*1 of the long hole portion 30*e* of the hinge hole is re-increased (0.208→0.4 mm) and the lower gap 30*e*2 is re-decreased (0.192→0 mm).

Figure 7K:
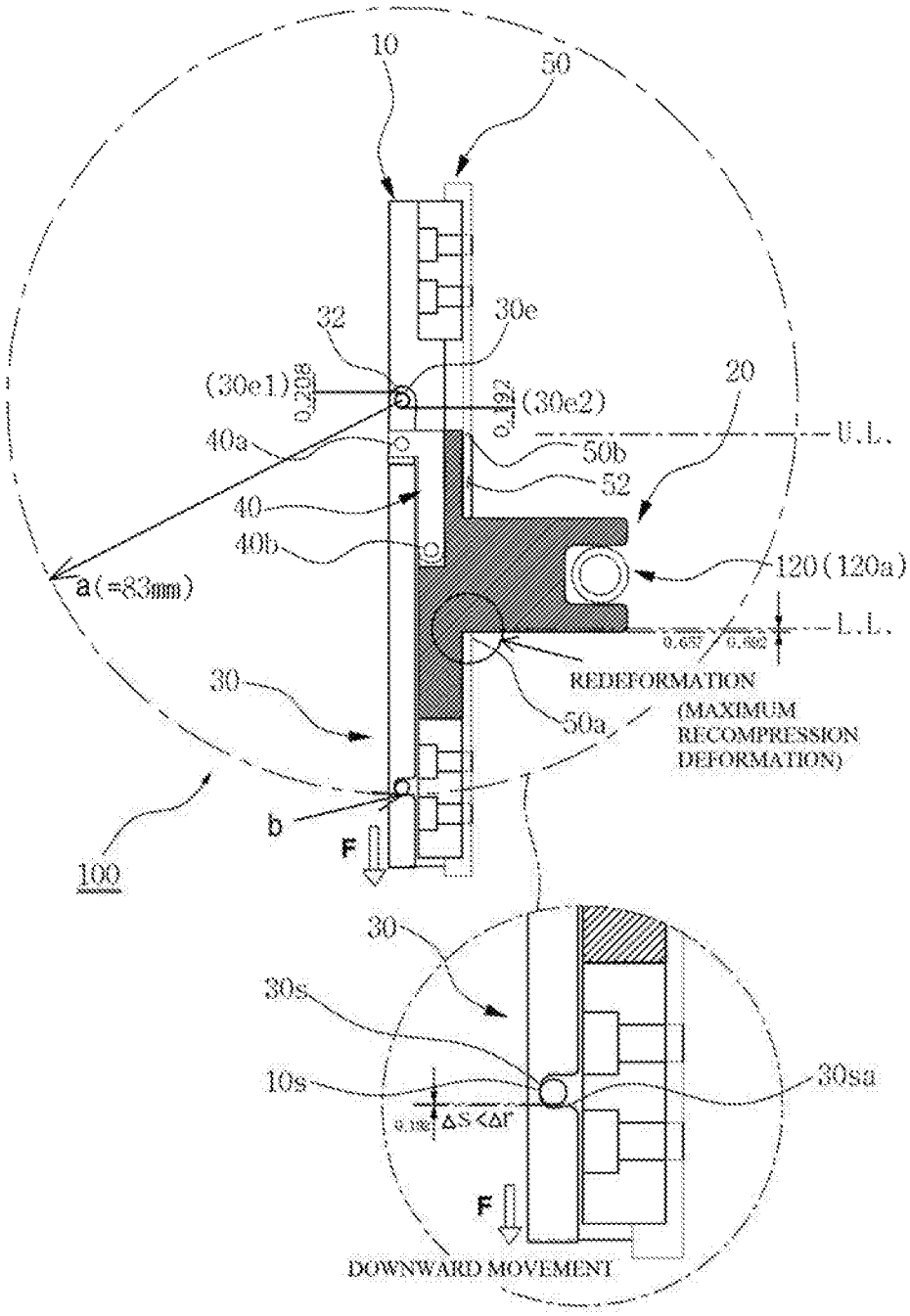
FIG. 7K is a cross-sectional view showing a state in which the rotatable lever is forcibly moved downward to rotate the rotatable lever in the reverse direction while the sliding block and the slider fork are in a downwardly fixed state (a noncontact uncompressed state, a uncompressed/locked state).

Therefore, as shown in FIG. 7K, to perform movement downward and rotation in the opposite direction of the rotatable lever 30 by a predetermined strength of external force F to re-pass through the lever recovery unit and the lever downward moving unit, reverse operations of the rotatable lever 30, the sliding block 20, and the slider fork 25 integrated with the sliding block 20 are limited until the elastic recompression deformation ('0.657 mm' deformation of FIG. 7K schematically showing a device according to the embodiment in which a rotation diameter a from the first hinge pin to the catching projection is 83 mm) of the cover plate-lower region 50*a* by the forcible further slight downward movement of the rotatable lever 30 is re-performed.

Both end portions of the conversion link bar 40 provided as an element of the switching device 100 are coupled to the rotatable lever 30 and the sliding block 20 through the second hinge pin 40*a* and the third hinge pin 40*b*, and in such a case, predetermined sizes and shapes of end accommodation grooves 30*a* and 20*a* (see FIG. 4B) are provided in the rotatable lever 30 and the sliding block 20 so as to not cause interference with both end portions of the conversion link bar 40, and the both end portions of the conversion link bar 40 are accommodated in the end accommodation grooves 30*a* and 20*a*, and thus a compact structure requiring a minimum space when the conversion link bar 40 is folded is provided.

Further, a sliding guide pad 15 (see FIGS. 3B and 6A) made of a self-lubricative material (for example, 'Turcite®'), which is mainly made of a material including at least one component selected from the group consisting of fluorocarbon complex, polyoxymethylene, nylon mono, monomer-cast (MC) nylon, high molecular polyethylene, and Teflon, is installed between the sliding block 20 and the housing 10 so that the sliding block 20 slides smoothly and linearly in the housing 10 in a longitudinal direction without noise.

When a rotation direction of the rotatable lever and an installation position of the rotatable lever releasing blocking unit have been described in a detailed description of the embodiments of the present invention, directional terms "upward" and "downward" have been used, but it is assumed that the device according to the present invention is installed in the door frame in the direction shown in the drawings. When the locking device according to the present invention is installed in a different direction, upward and downward directions may be reversed, or the direction may be leftward and rightward directions. Therefore, it should be understood that the directional terms are not to be construed as limiting the scope of the present invention, and various modifications and improvements by those skilled in the art using the basic concept of the present invention defined in the following claims are also within the scope of the present invention.

The invention claimed is:

1. A locking device of a hinged door (1) installed between a rotation opening side of the hinged door (1), which is installed in a door frame using a door hinge (1*b*) installed on one side of the door frame, and the door frame (1*a*), the locking device comprising: a plurality of close contact guide plates (130) installed on the rotation opening side of the hinged door (1) to be separated from each other in a longitudinal direction; a plurality of pressure rolls (120) configured to achieve a compressed locked state by pulling the rotation opening side of the hinged door (1) toward the door frame (la) while in contact with the plurality of close contact guide plates (130) in a state in which the rotation opening side of the hinged door (1) is closed on the door frame (1*a*) and configured to be installed on the door frame (1*a*) to be separated from each other in the longitudinal direction to achieve an uncompressed locked state between the rotation opening side of the hinged door (1) and the door frame (1*a*) in a noncontact state with the plurality of close contact guide plates (130); a driving plate (110) installed in a sliding pocket (110*a*), provided in the door frame (1*a*) in the longitudinal direction so that the pressure rolls 120 are slidably installed on the door frame (1*a*) in the longitudinal direction, and having the plurality of pressure rolls (120) provided in the longitudinal direction; and a switching device (100) configured to induce a longitudinal movement displacement (H) corresponding to that of the driving plate (110) by being engaged with at least one first pressure roll (120*a*) of the pressure rolls (120) installed on the driving plate (110) to provide the longitudinal movement displacement (H), configured to generate the longitudinal movement displacement (H) of a second pressure roll 120*b* induced by the longitudinal movement displacement (H) of the driving plate (110), and installed on the door frame (1*a*) to allow the second pressure roll (120*b*) to be switched between a contact compressed state position with the plurality of close contact guide plates (130) and a noncontact and uncompressed state position with the plurality of close contact guide plates (130) by the longitudinal movement displacement (H), wherein the switching device (100) further includes: a housing (10) fixedly installed on the door frame (la); a rotatable lever (30) installed in the housing (10) by a first hinge pin (32) to rotate on a front surface of the housing in the longitudinal direction; a conversion link bar (40) having one end portion connected at a predetermined position between the first hinge pin (32) of the rotatable lever (30) and a rotation end portion; a sliding block (20) connected to an other end portion of the conversion link bar (40) by a third hinge pin (40*b*) to slide linearly in the housing (10) in the longitudinal direction according to a longitudinal rotation operation of the rotatable lever (30); a cover plate (50) configured to cover a rear surface of the housing (10) to limit a displacement of the sliding block (20) by the longitudinal rotation operation of the rotatable lever (30) to a longitudinal linear sliding displacement in the housing (10) and having a hole formed in the longitudinal direction to guide the longitudinal linear sliding displacement and having a size such as to limit the height of the longitudinal linear sliding displacement; and a slider fork (25) integrated with the sliding block (20), provided to protrude to an outside of a sliding guide groove (52) formed in the cover plate (50), and sliding along the sliding guide groove (52) in the longitudinal direction while being engaged with the first pressure roll (120*a*).

2. The locking device of claim 1, wherein the switching device (100) further includes a rotatable lever releasing blocking unit for blocking release of the rotatable lever (30) before external force greater than a preset value is applied to the rotatable lever (30) to rotate the rotatable lever (30) so as to maintain the second pressure roll (120*b*) to be fixed at the contact compressed state position with the plurality of close contact guide plates (130) or a noncontact and uncompressed state position.

3. The locking device of claim 2, wherein, to provide a first rotatable lever releasing blocking unit which is one of the rotatable lever releasing blocking units, a neutral state (N.A.) in which the third hinge pin (40*b*), the first hinge pin (32), and a second hinge pin (40*a*) are sequentially disposed on an upward inclined straight line is made while the rotatable lever (30) composing the switching device (100) rotates upward about the first hinge pin (32) so that the second hinge pin (40*a*) is positioned above the first hinge pin (32), a sliding guide groove upper limit line (U.L.) is set at a position limiting a free further upward movement of the sliding block (20) and the slider fork (25) before the neutral state (N.A.), additional upward movements of the sliding block and the slider fork are elastically received by elastic compression deformation of an upper region (50*b*) of the cover plate (50) induced by an upward displacement exceeding the sliding guide groove upper limit line (U.L.) while the rotatable lever (30) rotates upward to reach the neutral state (N.A.), the sliding block (20) connected to the conversion link bar (40) and the slider fork (25) are moved slightly downward by elastically pressed elastic recovery deformation of the upper region (50*b*) of the cover plate (50) in a section in which the rotatable lever (30) additionally rotates upward to reach a vertically upright state beyond the neutral state (N.A.), and a position of a sliding guide groove upper limit line (U.L.) of the sliding guide groove (52) is set to limit a reverse direction operation of the rotatable lever (30), the sliding block (20), and the slider fork (25) integrated with the sliding block (20) until external force strong enough to re-perform elastic compression deformation of the upper region (50*b*) of the cover plate (50) is applied to the rotatable lever (30) according to slight upward movements of the sliding block (20) and the slider fork (25) for recovering the slight downward movement.

4. The locking device of claim 2, wherein, to provide a second rotatable lever releasing blocking unit which is another one of the rotatable lever releasing blocking units, the rotatable lever (30) composing the switching device (100) rotates downward about the first hinge pin (32) to reach a vertically downward state so that the second hinge pin (40*a*) is positioned below the first hinge pin (32) and a state in which the first hinge pin (32), the second hinge pin (40*a*), and the third hinge pin (40*b*) are disposed downward sequentially in a triangular structure is made, a sliding guide groove lower limit line (L.L.) is set at a position limiting additional free downward movements of the sliding block (20) and the slider fork (25) before the vertically downward state, additional downward movements of the sliding block (20) and the slider fork (25) are elastically received through elastic compression deformation induced by a downward displacement exceeding the sliding guide groove lower limit line (L.L.) while the rotatable lever (30) moves downward to reach the vertically downward state, a lever downward moving unit and a lever recovery unit are provided between the housing and the rotatable lever to induce a further slight downward movement and recovery of the rotatable lever (30) while the rotatable lever (30) rotates downward to reach the vertically downward state beyond the sliding guide groove lower limit line (L.L.) which limits free downward movements of the sliding block (20) and the slider fork (25), and reverse operations of the rotatable lever (30), the sliding block (20), and the slider fork (25) integrated with the sliding block (20) are limited until elastic compression deformation of a cover plate-lower region (50*a*) by forcible further slight downward movement of the rotatable lever (30) is re-performed by the rotatable lever (30) rotated from the lever recovery unit through the lever downward moving unit in a reverse direction.

5. The locking device of claim 4, wherein the lever downward moving unit includes: a catching protrusion (10*s*) protruding from a side wall of the housing (10); a catching projection (30*sa*) provided in an entrance portion of a catching groove (30*s*) formed in a side surface of the rotatable lever (30) to be concave to correspond to the catching protrusion (10*s*); and a long hole portion (30*e*), which is a hinge hole of the rotatable lever (30) to which the first hinge pin (32) is fastened to receive downward movement of the rotatable lever (30) performed when the catching projection (30*sa*) comes out of a lower end portion of the catching protrusion (10*s*), includes a vertical hole for the first hinge (32), wherein the lever recovery unit includes a catching protrusion expanded mounting portion (30*se*) in the catching groove (30*s*) provided to receive elastic recovery deformation of the cover plate-lower region (50*a*).

6. The locking device of claim 1, wherein the rotatable lever (30) and the sliding block (20) include end portion accommodating grooves (30*a* and 20*a*) with a predetermined size and shape to prevent interference with both end portions of the conversion link bar (40).

7. The locking device of claim 2, wherein the rotatable lever (30) and the sliding block (20) include end portion accommodating grooves (30*a* and 20*a*) with a predetermined size and shape to prevent interference with both end portions of the conversion link bar (40).

8. The locking device of claim 3, wherein the rotatable lever (30) and the sliding block (20) include end portion accommodating grooves (30*a* and 20*a*) with a predetermined size and shape to prevent interference with both end portions of the conversion link bar (40).

9. The locking device of claim 4, wherein the rotatable lever (30) and the sliding block (20) include end portion accommodating grooves (30*a* and 20*a*) with a predetermined size and shape to prevent interference with both end portions of the conversion link bar (40).

10. The locking device of claim 1, wherein a sliding guide pad (15) made of a self-lubricating material is installed between the sliding block (20) and the housing (10) so that the sliding block (20) slides smoothly and linearly in the housing (10) in the longitudinal direction without noise.

11. The locking device of claim 2, wherein a sliding guide pad (15) made of a self-lubricating material is installed between the sliding block (20) and the housing (10) so that the sliding block (20) slides smoothly and linearly in the housing (10) in the longitudinal direction without noise.

12. The locking device of claim 3, wherein a sliding guide pad (15) made of a self-lubricating material is installed between the sliding block (20) and the housing (10) so that the sliding block (20) slides smoothly and linearly in the housing (10) in the longitudinal direction without noise.

13. The locking device of claim 4, wherein a sliding guide pad (15) made of a self-lubricating material is installed between the sliding block (20) and the housing (10) so that the sliding block (20) slides smoothly and linearly in the housing (10) in the longitudinal direction without noise.

* * * * *